US006408952B1

(12) United States Patent
Brand et al.

(10) Patent No.: US 6,408,952 B1
(45) Date of Patent: Jun. 25, 2002

(54) REMOTE LOCK-OUT SYSTEM AND METHOD FOR A HORIZONTAL DIRECTION DRILLING SYSTEM

(75) Inventors: Ivan R. Brand; Gregg A. Austin; Fred G. Delonti, all of Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/466,502

(22) Filed: Dec. 17, 1999

(51) Int. Cl.[7] ..... E21B 44/00

(52) U.S. Cl. ..... 175/24; 175/27; 175/45; 340/853.4; 340/853.6

(58) Field of Search ..... 175/19, 24, 26, 175/27, 40, 45, 48, 61; 340/853.2, 853.3, 863.4, 853.5, 853.6

(56) References Cited

U.S. PATENT DOCUMENTS

| | | | | |
|---|---|---|---|---|
| 4,907,658 A | | 3/1990 | Stangl et al. | |
| 4,968,978 A | * | 11/1990 | Stolarczyk | 175/40 |
| 5,337,002 A | | 8/1994 | Mercer | |
| 5,465,798 A | | 11/1995 | Edlund et al. | |
| 5,469,155 A | | 11/1995 | Archambeault et al. | |
| 5,556,253 A | | 9/1996 | Rozendaal et al. | |
| 5,633,589 A | | 5/1997 | Mercer | |
| 5,698,981 A | | 12/1997 | Mercer | |
| 5,746,278 A | | 5/1998 | Bischel et al. | |
| 5,764,062 A | | 6/1998 | Mercer | |
| 5,767,678 A | | 6/1998 | Mercer | |
| 5,944,121 A | | 8/1999 | Bischel et al. | |
| 6,035,951 A | | 3/2000 | Mercer et al. | |
| 6,047,783 A | | 4/2000 | Mercer et al. | |
| 6,057,687 A | | 5/2000 | Mercer | |
| 6,079,506 A | | 6/2000 | Mercer | |
| 6,095,260 A | | 8/2000 | Mercer et al. | |
| 6,161,630 A | * | 12/2000 | Stump et al. | 175/40 |
| 6,285,860 B1 | | 9/2001 | Szarka et al. | |

* cited by examiner

*Primary Examiner*—William Neuder
(74) *Attorney, Agent, or Firm*—Crawford Maunu PLLC

(57) ABSTRACT

Systems and methods for remotely altering operation of a horizontal directional drilling machine provide for remotely disabling movement of a drill string coupled to a cutting head or reamer and, in addition, disabling dispensing of fluid, foam and/or air communicated through the drill string. A lockout signal is transmitted from a portable or hand-manipulatable remote unit operated by an operator remotely situated with respect to the drilling machine. The lockout signal is received at the drilling machine. In response to the received lockout signal, a controller of the drilling machine prevents movement of the drill string and thus the cutting head or reamer. The controller also disables dispensing of fluid, foam and/or air through the drill string in response to the received lockout signal. The controller effects transmission of a verification signal from the drilling machine to the remote location. The verification signal indicates successful receipt of the lockout signal by the drilling machine, disablement of drill string movement and, if applicable, disablement of fluid, foam and/or air supply through the drill string. The remote unit, in response to the verification signal received from the drilling machine, communicates to a user of the remote unit one or more of a visual, audible, and/or tactile indication that the verification signal has been received, thus providing unambiguous assurance to operators working on or proximate the drill string/cutting head that all drill string/cutting head movement and fluid dispensed through the drill string has been successfully disabled.

33 Claims, 16 Drawing Sheets

REMOTE LOCK-OUT SYSTEM AND METHOD FOR A HORIZONTAL DIRECTION DRILLING SYSTEM

BACKGROUND OF THE INVENTION

The present invention relates generally to the field of underground boring and, more particularly, to a system and method of altering operation of an underground boring system, including disabling drill string movement and fluid flow through the drill string, from a location remote from the boring system.

Utility lines for water, electricity, gas, telephone, and cable television are often run underground for reasons of safety and aesthetics. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, an open trench may pose a danger of injury to workers and passersby.

The general technique of boring a horizontal underground hole has recently been developed in order to overcome the disadvantages described above, as well as others unaddressed when employing conventional trenching techniques. In accordance with such a general horizontal boring technique, also known as microtunnelling, horizontal directional drilling (HDD) or trenchless underground boring, a boring system is situated on the ground surface and drills a hole into the ground at an oblique angle with respect to the ground surface. A drilling fluid is typically flowed through the drill string, over the boring tool, and back up the borehole in order to remove cuttings and dirt. After the boring tool reaches a desired depth, the tool is then directed along a substantially horizontal path to create a horizontal borehole. After the desired length of borehole has been obtained, the tool is then directed upwards to break through to the earth's surface. A reamer is then attached to the drill string which is pulled back through the borehole, thus reaming out the borehole to a larger diameter. It is common to attach a utility line or other conduit to the reaming tool so that it is dragged through the borehole along with the reamer.

Another technique associated with horizontal directional drilling, often referred to as push reaming, involves attaching a reamer to the drill string at the entry side of a borehole after the boring tool has exited at the exit side of the borehole. The reamer is then pushed through the borehole while the drill rods being advanced out of the exit side of the borehole are individually disconnected at the exit location of the borehole. A push reaming technique is sometimes used because it advantageously provides for the recycling of the drilling fluid. The level of direct operator interaction with the drill string, such as is required to disconnect drill rods at the exit location of the borehole, is much greater than that associated with traditional horizontal directional drilling techniques.

It can be appreciated that unintended movement of the drill string and/or cutting head at the exit location of the bore may represent a significant hazard to workers at the exit location. A suggested approach to addressing the potential hazards facing workers at the exit location of a bore involves the use of a device that permits a worker at the exit location to terminate advancement or rotation of the drill string/cutting head. Although such an approach would appear to allow the worker to terminate drill string/cutting head advancement and/or rotation, this and other known approaches to addressing the problem of unintended drill string/cutting head movement at the exit location fail to provide unambiguous assurance to the worker at the exit location that the instruction to terminate drill string/cutting head advancement/rotation has been received by the drilling machine.

Such conventional and suggested approaches also fail to provide unambiguous assurance to the worker at the exit location that the steps required to disable drill string/cutting head advancement/rotation at the drilling machine have been successfully completed. Further, such conventional and suggested approaches fail to provide unambiguous assurance to the worker that all drill string/cutting head advancement/rotation will remain disabled, particularly in circumstances where the drilling machine engine is intentionally or unintentionally shut-off and then turned-on or where communication connectivity between the worker and the drilling machine is suspect or lost. Moreover, the potential hazard of dispensing high-pressure drilling fluid at the exit location remains unaddressed by such conventional and suggested approaches.

There exists a need in the excavation industry for an apparatus and methodology for preventing drill string/cutting head movement and, in addition, disabling cutting fluid flow by a worker situated remotely from the drilling machine. There exists the further need for such an apparatus and methodology that provides unambiguous assurance to the worker that all drill string/cutting head movement and fluid flow will remain disabled until such time as the worker participates with the drilling machine operator to purposefully enable the drilling machine for normal operation. There exists yet an additional need for such an apparatus and methodology that enables the drilling machine operator to perform certain limited drilling machine operations, while ensuring that all drill string/cutting head movement is disabled. The present invention fulfills these and other needs.

SUMMARY OF THE INVENTION

The present invention is directed to systems and methods for remotely altering operation of a horizontal directional drilling machine, including remotely preventing and/or limiting movement of a cutting head or reamer and disabling dispensing of fluid, foam and/or air into the borehole. A lockout signal is transmitted from a location remote from the drilling machine, preferably by use of a portable or hand-manipulatable remote unit operated by an operator remotely situated with respect to the drilling machine. The lockout signal transmitted by the remote unit is received at the drilling machine. In response to the received lockout signal, a controller of the drilling machine prevents movement of the drill string, such as by disabling displacement and rotation of the drill string to which the cutting head or reamer is coupled. The controller also disables dispensing of fluid, foam and/or air into the borehole in response to the received lockout signal.

The controller effects transmission of a verification signal from the drilling machine to the remote location. The verification signal indicates successful receipt of the lockout signal by the drilling machine, prevention of all drill string movement, and disablement of fluid, foam and/or air supply into the borehole. The remote unit, in response to the verification signal received from the drilling machine, communicates to a user of the remote unit one or more of a visual, audible, and/or tactile indication that the verification signal has been received. Receipt of the verification signal and communication to the remote user of same provides unambiguous assurance to operators working on or proximate the drill string and, in particular, the cutting head or reamer that all drill string/cutting head/reamer movement and, if applicable, fluid dispensed into the borehole has been successfully disabled.

According to another mode of operation, the controller, in response to a lockout signal, prevents all drill string movement, yet provides for limited drilling machine functionality in connection with drill rod manipulation. A drill rod manipulation mode of operation provides for assured prevention of downhole drill string movement, while providing for limited drilling machine functionality, such as automated or manual loading of a new rod to the drill string or returning a rod to storage and preparing to retrieve the next rod. When operating the drilling machine in a drilling rod manipulation mode, movement of the drill string is prevented by use of a clamping mechanism at the drilling machine. After successful clamping of the drill string is verified, such as by use of a sensor at the clamping mechanism, the driving apparatus of the drilling machine may be operated to perform certain tasks. One such task involves loading a new rod for addition to the drill string and manipulating the newly loaded rod so as to thread the new rod to the drill string. In a preferred embodiment, the driving apparatus is purposefully limited in terms of torque and/or thrust to ensure that the clamping apparatus maintains the drill string in a non-moving state during rod manipulation (e.g., when rods are threaded and/or unthreaded from the drill string).

A system and method according to the present invention may further provide a number of additional features that enhance operational integrity and safety. One or more of a visual, audible and/or tactile warning indication, for example, may be communicated to a user of the remote unit in response to a change of state at the drilling machine that affects movement of the drill string and/or supply of fluid, foam and/or air to the cutting head. One or both of a visual and/or audible indication of receipt of the lockout signal transmitted from the remote unit may be communicated to an operator of the drilling machine.

A timer may be provided in the remote unit which is programmed to have a pre-established timeout period. The timer is activated upon transmission of the lockout signal by the remote unit. One or more of a visual, audible, and/or tactile warning indication is communicated to the remote user in response to the remote unit receiving the verification signal from the drilling machine after expiration of the pre-established timeout period following transmission of the lockout signal.

A loss of communication connectivity between the drilling machine and the remote location is preferably detected by the remote unit. One or more of a visual, audible and/or tactile indication of a loss of communication connectivity between the drilling machine and the remote location is communicated to a user at the remote location. An indication of the relative strength of a signal transmitted from the drilling machine and received at the remote location may also be determined and indicated to the remote user.

The remote unit may further provide a remote operator with the ability to alter operation of the drilling machine in a variety of ways, such as by instructing the drilling machine to operate in one of a number of selectable operating modes. An operating mode signal representative of a user selected operating mode is transmitted by the remote unit and received at the drilling machine. In response to the operating mode signal, the operation of the drilling machine is altered according to the selected operating mode. Altering drilling machine operation may be effected automatically or in response to user control inputs at the drilling machine.

The operating mode signal may, for example, comprise a CREEP mode signal, In response to the CREEP mode signal, the controller of the drilling machine reduces one or both of cutting head or reamer rotation and/or displacement from a nominal level to a pre-established level. The operating mode signal may further comprise one of a PUSH, PULLBACK or ROTATE mode signal. The controller alters a rate and/or force of forward cutting head or reamer displacement in response to the PUSH mode signal, alters a rate and/or force of reverse cutting head or reamer displacement in response to the PULLBACK mode signal or alters a rate of cutting head or reamer rotation in response to the ROTATE mode signal. The operating mode signal may also comprise a STEERING mode signal. The controller of the drilling machine effects boring tool heading changes in response to the STEERING mode signal. A steering control provided on the remote unit may comprise a plurality of switches each representative of a position on a clock face. The STEERING mode signal generated by the steering control is representative of a desired cutting head steering direction corresponding to the position of the actuated switch on the clock face.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
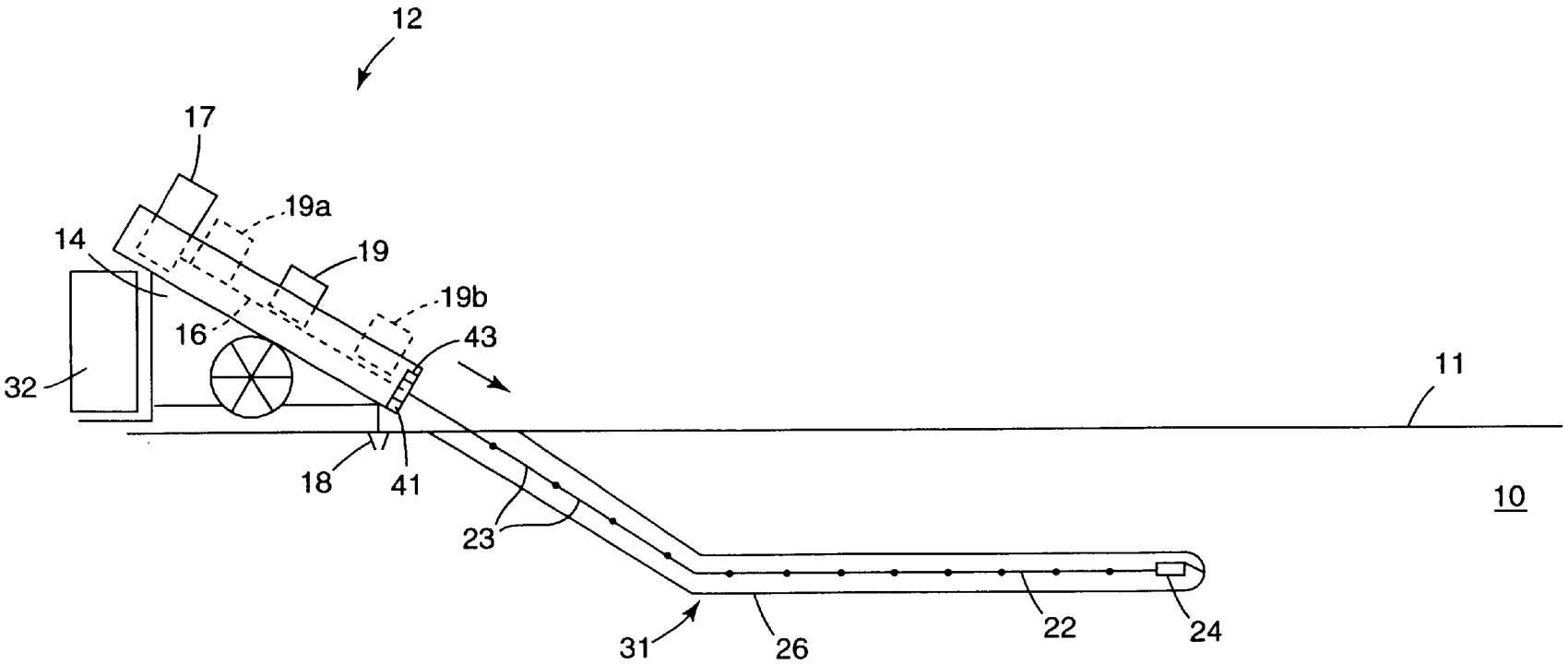
FIG. 1 is a side view of an underground boring apparatus in accordance with an embodiment of the present invention.

While the invention is amenable to various modifications and alternative forms, specifics thereof have been shown by way of example in the drawings and will be described in detail hereinbelow. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF THE EMBODIMENTS

In the following description of the illustrated embodiments, references are made to the accompanying drawings which form a part hereof, and in which is shown by way of illustration, various embodiments in which the invention may be practiced. It is to be understood that other embodiments may be utilized, and structural and functional changes may be made without departing from the scope of the present invention.

Referring now to the figures and, more particularly to FIG. 1, there is illustrated an embodiment of a horizontal directional drilling (HDD) machine which incorporates a control system and methodology for implementing a remote LOCK-OUT methodology of the present invention. The term LOCK-OUT is generally understood in various fields as a safety protocol by which a component or process is intentionally disabled (i.e., locked-out). In addition, an indication of such disablement may be communicated in some manner (i.e., tagged-out). Enabling of the intentionally disabled component or process typically involves the completion of a verification step or sequence of steps of limited complexity that protects against inadvertent reinstatement of the process or component activity.

Systems and methods of the present invention are directed to implementing a LOCK-OUT methodology by which certain operations of an HDD machine are disabled or limited upon receiving a LOCK-OUT command from a remote source. Systems and methods of the present invention are also directed to remotely altering and/or controlling the operation of an HDD machine when operating in one of a number of modes, such as a CREEP mode, ROTATE mode, PUSH mode, PULLBACK mode and rod manipulation mode, and when implementing cutting head steering changes.

The advantages and benefits of the present invention may be realized by incorporating a LOCK-OUT methodology of the present invention in new HDD machine designs. Advantageously, a LOCK-OUT methodology of the present invention may be incorporated in certain existing HDD machines, typically by upgrading the controller's software and provision of a remote unit of the present invention.

FIG. 1 illustrates a cross-section through a portion of ground 10 where a horizontal directional drilling operation takes place. The HDD machine 12 is situated aboveground 11 and includes a platform 14 on which is situated a tilted longitudinal member 16. The platform 14 is secured to the ground by pins 18 or other restraining members in order to prevent the platform 14 from moving during the drilling or boring operation. Located on the longitudinal member 16 is a thrust/pullback pump 17 for driving a drill string 22 in a forward and/or reverse longitudinal direction. The drill string 22 is made up of a number of drill string members or rods 23 attached end-to-end.

Also located on the tilted longitudinal member 16, and mounted to permit movement along the longitudinal member 16, is a rotation motor or pump 19 for rotating the drill string 22 (illustrated in an intermediate position between an upper position 19*a* and a lower position 19*b*). In operation, the rotation motor 19 rotates the drill string 22 which has a cutting head or reamer 24 attached at the end of the drill string 22.

A typical boring operation takes place as follows. The rotation motor 19 is initially positioned in an upper location 19*a* and rotates the drill string 22. While the boring tool 24 is rotated, the rotation motor 19 and drill string 22 are pushed in a forward direction by the thrust/pullback pump 17 toward a lower position into the ground, thus creating a borehole 26.

The rotation motor 19 reaches a lower position 19*b* when the drill string 22 has been pushed into the borehole 26 by the length of one drill string member 23. With the rotation motor 19 situated at lower position 19*b*, a clamp 41 then grips the drill string to 22 to stop all downhole drill string movement. A clamp sensor 43 senses actuation of clamp 41 and generates a clamp signal when the clamp 41 properly engages the drill string 22. Clamp sensor 43 may sense displacement of the clamp mechanism and may generate a clamp signal when the clamp mechanism has traveled a distance sufficient to provide for secured engagement with the drill string 22.

The rotation motor 19 is then uncoupled from the clamped drill string 22 and pulled back to upper location 19*a*. A new drill string member or rod 23 is then added to the drill string 22 either manually or automatically. The clamping mechanism then releases the drill string and the thrust/pullback pump 17 drives the drill string 22 and newly added rod 23 into the borehole. The rotation motor 19 is thus used to thread a new drill string member 23 to the drill string 22, and the rotation/push process is repeated so as to force the newly lengthened drill string 22 further into the ground, thereby extending the borehole 26.

Commonly, water or other fluid is pumped through the drill string 22 by use of a mud or water pump. If an air hammer is used as the cutting implement 24, an air compressor is employed to force air/foam through the drill string 22. The water/mud or air/foam flows back up through the borehole 26 to remove cuttings, dirt, and other debris. A directional steering capability is provided for controlling the direction of the boring tool 24, such that a desired direction can be imparted to the resulting borehole 26. Exemplary systems and methods for controlling an HDD machine of the type illustrated in the Figures are disclosed in commonly assigned U.S. Pat. Nos. 5,746,278 and 5,720,354, and U.S. application Ser. Nos. 09/405,890 and 09/405,889 filed concurrently on Sep. 24, 1999; all of which are hereby incorporated herein by reference in their respective entireties.

Figure 2:
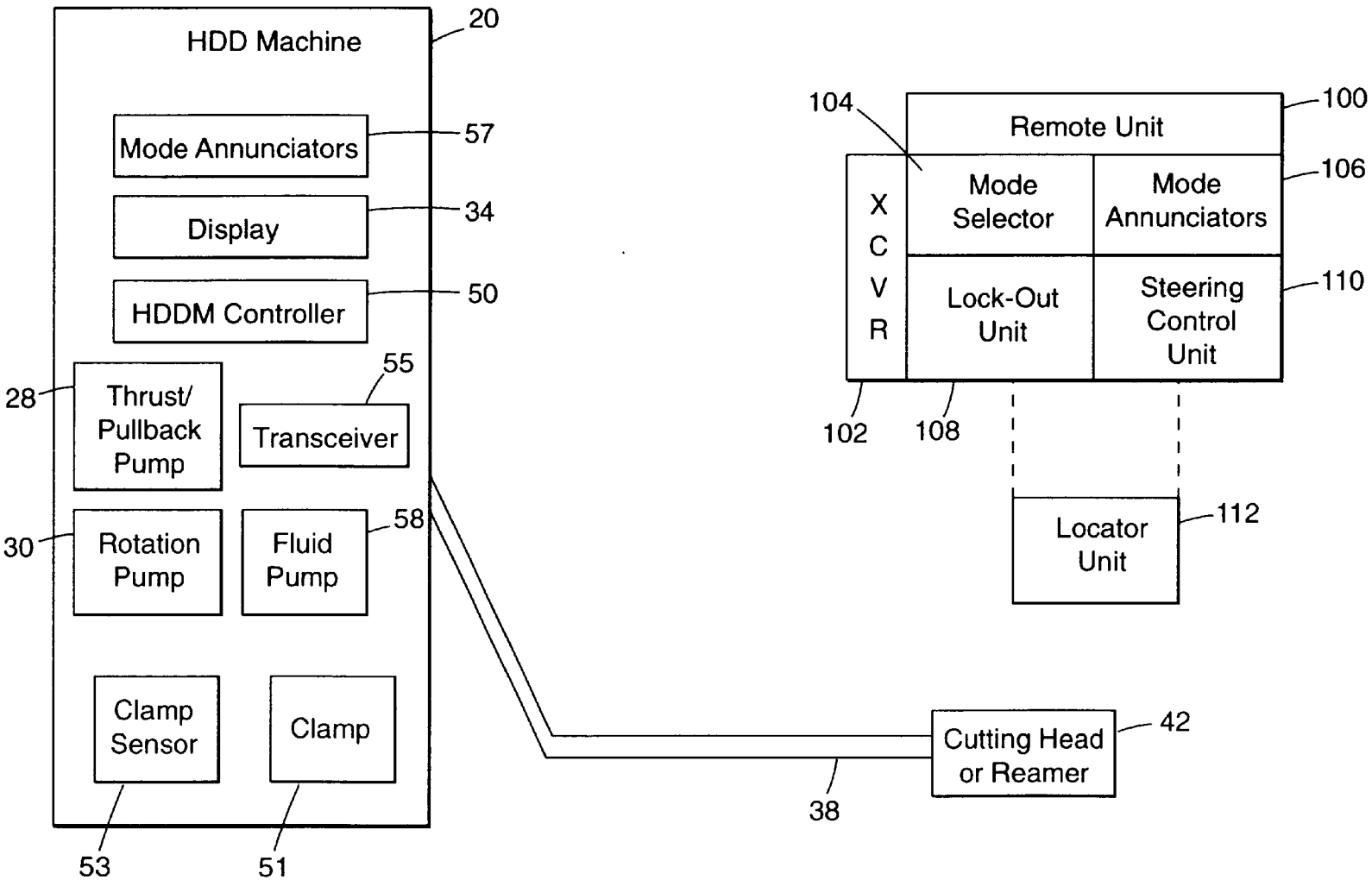
FIG. 2 is a block diagram of a remote unit operable by a remote operator that cooperates with a controller of a horizontal directional drilling (HDD) machine to implement a remote LOCK-OUT methodology in accordance with an embodiment of the present invention.

FIG. 2 is a block diagram of a remote unit 100 that cooperates with a controller 50 of a horizontal directional drilling machine (HDDM) to implement a remote LOCK-OUT methodology in accordance with an embodiment of the present invention. Many of the components of HDD machine 20 shown in FIG. 2 are generally representative of those having like numerical references with respect to HDD machine 20 shown in FIG. 1. As such, the HDD machine shown in FIG. 1 may be readily retrofitted to include the system components and/or controller software associated with the system of FIG. 2 in order to implement a LOCK-OUT methodology according to the principles of the present invention.

With continued reference to FIG. 2, HDD machine 20 includes a main controller or processor, referred to herein as HDDM controller 50, which controls the operations of HDD machine 20 when operating in several different modes, including a LOCK-OUT mode. HDDM controller 50 controls the movement of a cutting head or reamer 42 and drill string 38 by appropriately controlling a thrust/pullback pump 28, alternatively referred to as a displacement pump 28, and a rotation pump 30, each of which is mechanically coupled to the drill string 38. HDDM controller 50 also controls a fluid pump 58, alternatively referred to as a "mud" pump, which dispenses a cutting fluid (e.g., water, mud, foam, air) to the cutting head 42 via the drill string 38.

The HDD machine 20 further includes a clamping apparatus 51 which is used to immobilize the drill string 38 during certain operations, such as when adding or removing a drill rod to/from the drill string 38. In one embodiment, the HDD controller 50 provides for limited usage of the thrust/pullback pump 28 and rotation pump 30 when operating in a LOCK-OUT mode. As will be discussed in greater detail hereinbelow, the HDD controller 50 activates the clamping mechanism during a LOCK-OUT procedure to prevent movement of the downhole drill string 38. Upon receiving a signal from a clamp sensor 53 that the clamping mechanism 51 has properly engaged and immobilized the drill string 38, the HDD controller 50 permits limited thrust/pullback pump 28 and rotation pump 30 usage. The HDD controller 50 may coordinate the manipulation of drill rods in cooperation with an automatic rod loader apparatus of the type disclosed in commonly assigned U.S. Pat. No. 5,556,253, which is hereby incorporated herein by reference in its entirety.

HDDM controller 50 is further coupled to a display 34 and/or a number of mode annunciators 57. Display 34 may be used to communicate various types of information to the HDD machine operator, such as pump pressures, engine output, boring tool location and orientation data, operating mode information, remote steering and operating requests/commands, and the like. Mode annunciators 57 provide the machine operator with particularized information concerning various functions initiated by or in cooperation with remote unit 100. Mode annunciators 57 typically include one or more visual, audible, and/or tactile (e.g., vibration) indicators. A transceiver 55 is provided on HDD machine 20 to facilitate the communication of signals and information between HDD machine 20 and remote unit 100.

Remote unit 100 is preferably configured as a hand-held unit that incorporates controls which are readily actuatable by an operator situated remote from the HDD machine 20. In one embodiment, all of the controls and/or switches provided on the hand-held remote unit 100 are readily actuatable by an operator using only one hand, that being the hand holding the remote unit 100. The remote unit 100 may incorporate ergonomic features that facilitate easy grasping and retention of the unit 100 in the hand, and features that promote easy interaction between the remote user and the remote unit 100. According to this embodiment, remote unit 100 includes a belt clip or other arrangement that facilitates easy detachability between remote unit 100 and the remote user.

In accordance with another embodiment, remote unit 100 may be incorporated into a portable locator or tracking unit 112 as is known in the art. A remote operator may use locator 112, which incorporates remote unit 100 functionality, to perform conventional tasks, such as scanning an area above the cutting head 42 for purposes of detecting a magnetic field produced by an active sonde provided within the cutting head 42. In addition to the availability of standard locator functions, various LOCK-OUT and remote steering functions according to the present invention may be selectively implemented using a locator modified to incorporate remote unit 100 functionality. Examples of such known locators are disclosed in U.S. Pat. Nos. 5,767,678; 5,764,062; 5,698,981; 5,633,589; 5,469,155; 5,337,002; and 4,907,658; all of which are hereby incorporated herein by reference in their respective entireties. These systems may be advantageously modified to include components and functionality described herein to provide for LOCK-OUT and remote steering capabilities in accordance with the principles of the present invention.

The embodiment of remote unit 100 shown in FIG. 2 includes a LOCK-OUT unit 108 which incorporates a LOCK-OUT control or switch. The LOCK-OUT unit 108, in response to actuation of the LOCK-OUT switch by the remote user, initiates a LOCK-OUT sequence which results in the expedient termination of drill string 38/cutting head 42 movement and fluid flow to the cutting head 42. As will be discussed in greater detail hereinbelow, and in contrast to conventional safety schemes, the LOCK-OUT unit 108 and mode annunciators 106 of remote unit 100 cooperate with HDDM controller 50 of HDD machine 20 to assure the remote operator, without ambiguity, that all drill string 38/cutting head 42 movement has been disabled. The remote operator, after receiving verification that the LOCK-OUT sequence had been successfully completed, may then work closely or directly with the cutting head 42 and/or drill string 38 with confidence, knowing that no further cutting head 42/drill string 38 movement or fluid dispensing will occur until the LOCK-OUT state is purposefully and properly reset by both the remote operator and the HDD machine operator.

Remote unit 100 also includes a mode selector 104 and a number of mode annunciators 106. Mode selector 104 permits the remote operator to select one of a number of different operating modes, such as a CREEP, ROTATE, PUSH, and PULLBACK modes, and when implementing boring tool steering changes via steering control unit 110. An indication of the selected mode and other information, such as a warning indication, is communicated to the remote user via mode annunciators 106. Mode annunciators 106 typically include one or more visual, audible, and/or tactile (e.g., vibration) indicators. Alternatively, or in addition to mode annunciators 106, remote unit 100 may be provided with a display.

A transceiver 102 of remote unit 100 permits the remote unit 100 to communicate with HDD machine 20 via transceiver 55 of HDD machine 20. To facilitate communication between remote unit 100 and HDD machine 20, one or more repeaters may be situated at appropriate locations at the drilling site. The use of repeaters may be desirable or required when hills or other natural or manmade obstructions lie between the remote unit 100 and HDD machine 20. Repeaters may also be used to provide for increased signal-to-noise (SNR) ratios. Communication between remote unit 100 and HDD machine 20 may be enhanced by using one or more repeaters when drilling boreholes having lengths on the order of thousands of feet (e.g., one mile). Those skilled in the art will appreciate that a number of communication links and protocols may be employed to facilitate the transfer of information between remote unit 100 and HDD machine 20, such as those that employ wire or free-space links using infrared, microwave, laser or acoustic telemetry approaches, for example.

Figure 3A:
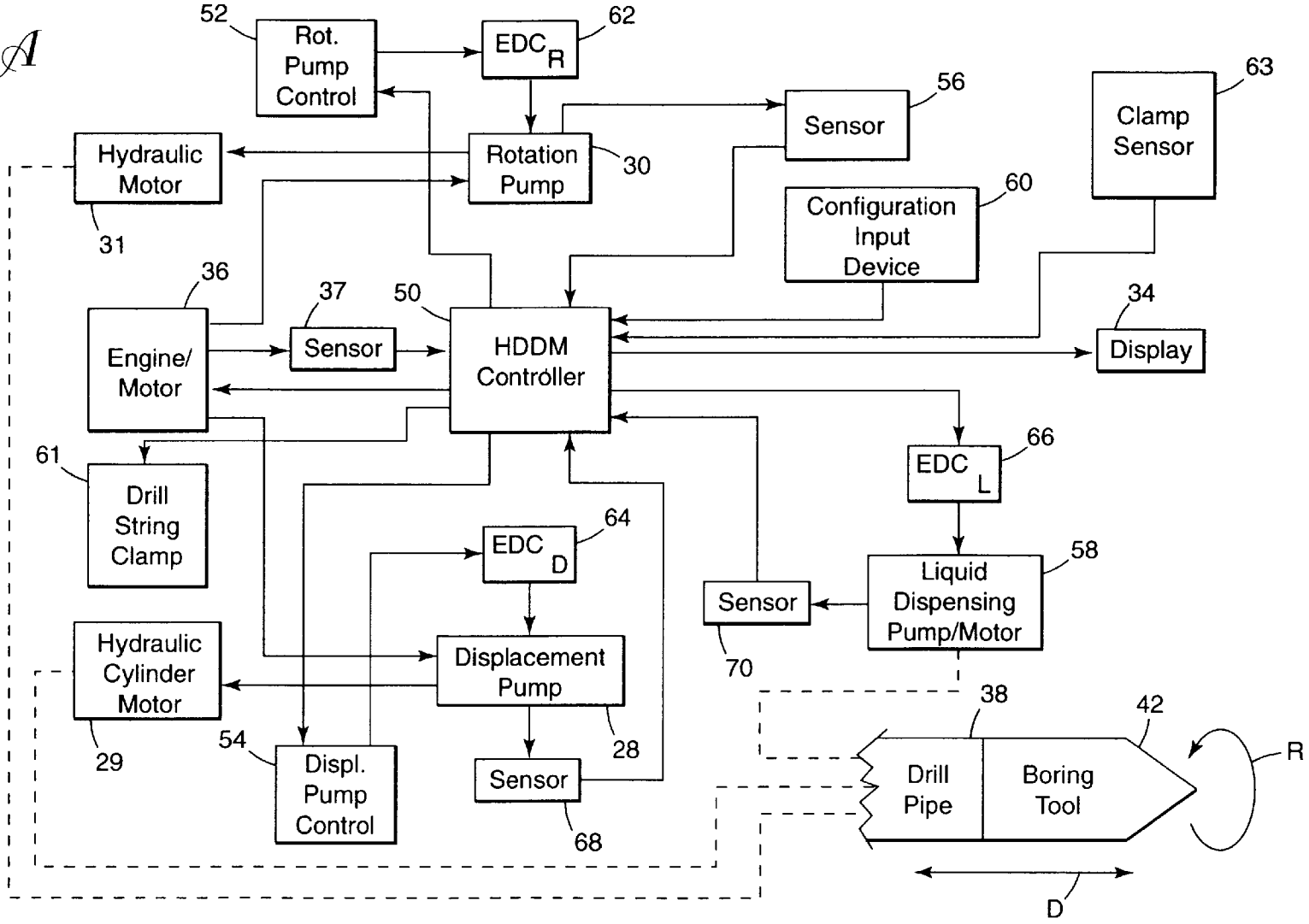
FIG. 3A depicts a control system of an HDD machine that cooperates with a remote unit to implement a remote LOCK-OUT methodology in accordance with an embodiment of the present invention.
Figure 3B:
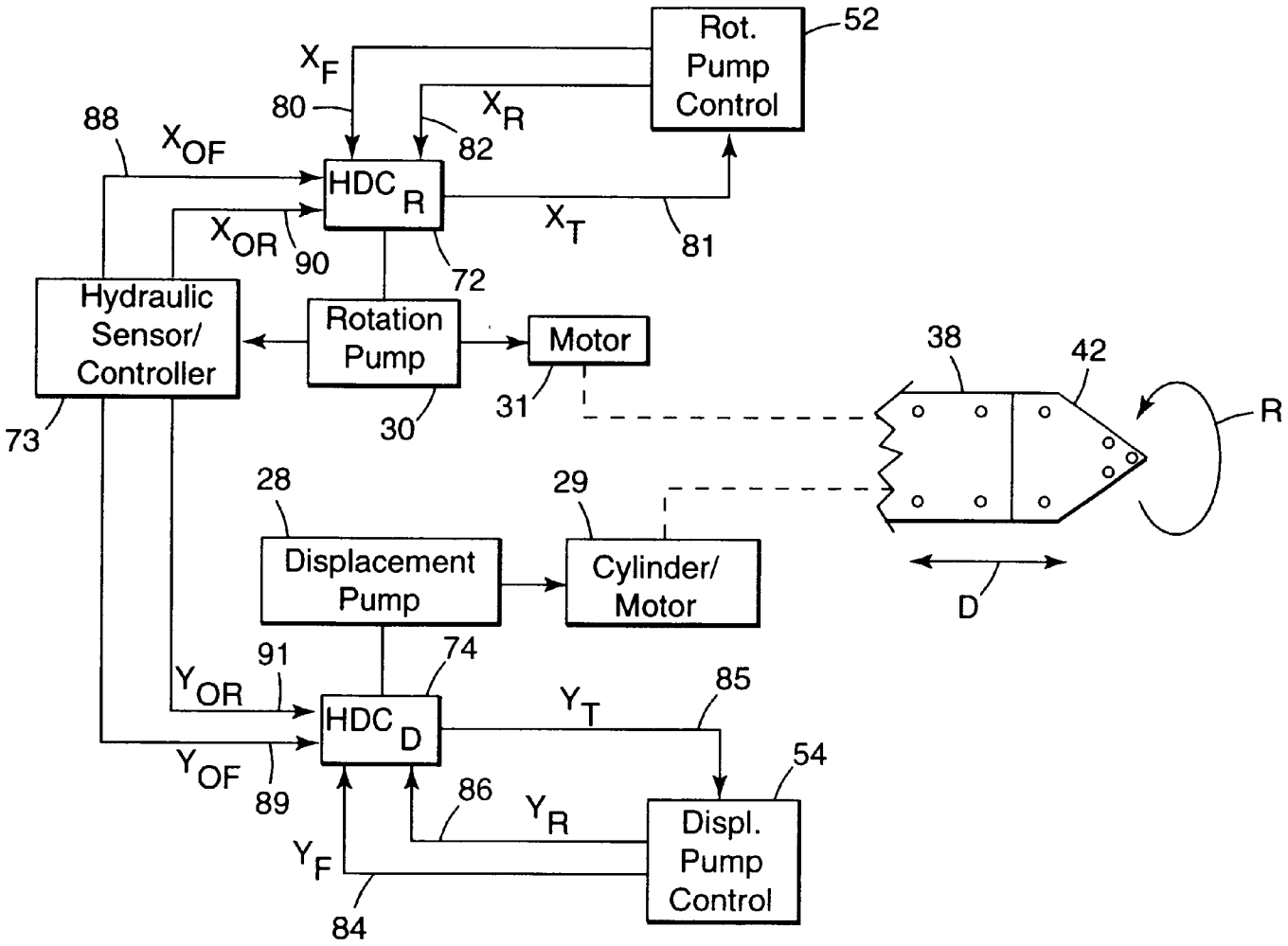
FIG. 3B depicts a control system of an HDD machine that cooperates with a remote unit to implement a remote LOCK-OUT methodology in accordance with another embodiment of the present invention.

Referring now to FIG. 3A, there is illustrated one embodiment of a control system of an HDD machine for controlling drilling activities during normal operation and for implementing a LOCK-OUT methodology in accordance with the principles of the present invention. Although specific control system implementations are depicted in FIGS. 3A and FIG. 3B, it will be understood that a control system suitable for effecting a LOCK-OUT methodology of the present invention may be implemented using electrical, mechanical, or hydraulic control elements or any combination thereof.

With continued reference to FIG. 3A, the operation of a displacement pump 28 and a rotation pump 30 is controlled by HDDM controller 50. HDDM controller 50 is also coupled to an engine/motor 36 of the HDD machine which provides source power respectively to the displacement and rotation pumps 28 and 30. A rotation pump sensor 56 is coupled to the rotation pump 30 and HDDM controller 50, and provides an output signal to HDDM controller 50 corresponding to a pressure or pressure differential, or alternatively, a speed of the rotation pump 30. A rotation pump control 52 and a displacement pump control 54 provide for manual control over the rate at which drilling or back reaming is performed. During idle periods, the rotation and displacement pump controls 52 and 54 are preferably configured to automatically return to a neutral setting at which no rotation or displacement power is delivered to the cutting head 42 for purposes of enhancing safety.

Modification to the operation of the displacement pump 28 and rotation pump 30 is controlled by HDDM controller 50. A rotation pump sensor 56, coupled to the rotation pump 30 and HDDM controller 50, provides an output signal to HDDM controller 50 corresponding to the pressure or pressure differential, or alternatively, the rotation speed of the rotation pump 30. A displacement pump sensor 68, coupled to the displacement pump 28 and HDDM controller 50, provides an output signal to HDDM controller 50 corresponding to the pressure level of the displacement pump 28 or, alternatively, the speed of the displacement pump 28. A rotation pump control 52 and a displacement pump control 54 provide for manual control over the rate at which drilling or back reaming is performed.

An operator typically sets the rotation pump control 52 to a desired rotation setting during a drilling or back reaming operation, and modifies the setting of the displacement pump control 54 in order to change the rate at which the cutting head 42 is displaced along an underground path when drilling or back reaming. The rotation pump control 52 transmits a control signal to an electrical displacement control 62 ($EDC_R$) coupled to the rotation pump 30. $EDC_R$62 converts the electrical control signal to a hydrostatic control signal which is transmitted to the rotation pump 30 for purposes of controlling the rotation rate of the cutting head 42.

The operator also sets the displacement pump control 54 to a setting corresponding to a preferred boring tool displacement rate. The operator may modify the setting of the displacement pump control 54 to effect gross changes in the rate at which the cutting head 42 is displaced along an underground path when drilling or back reaming. The displacement pump control 54 transmits a control signal to a second EDC 64 ($EDC_D$) coupled to the displacement pump 28. $EDC_D$ 64 converts the electrical control signal received from the controller 64 to a hydrostatic control signal, which is then transmitted to the displacement pump 28 for purposes of controlling the displacement rate of the cutting head 42.

The HDD machine also includes a liquid dispensing pump/motor 58 (hereinafter referred to as a liquid dispensing pump) which communicates liquid through the drill string 38 and cutting head 42 for purposes of providing lubrication and enhancing boring tool productivity. The operator generally controls the liquid dispensing pump 58 to dispense liquid, preferably water, a water/mud mixture or a foam, at a preferred dispensing rate by use of an appropriate control lever or knob provided on the control panel 32 shown in FIG. 1. Alternatively, the dispensing rate of the liquid dispensing pump 58, as well as the settings of the rotation pump 30, displacement pump 28, and engine 36, may be set and controlled using a configuration input device 60, which may be a keyboard, keypad, touch sensitive screen or other such input interface device, coupled to HDDM controller 50. HDDM controller 50 receives the liquid dispensing setting produced by the control lever/knob provided on the control panel 32 or, alternatively, the configuration input device 60, and transmits an electrical control signal to a third EDC 66 ($EDC_L$) which, in turn, transmits a hydrostatic control signal to the liquid dispensing pump 58.

A feedback control loop provides for automatic adjustment to the rate of the displacement pump 28 and rotation pump 30 in response to varying drilling conditions. The feedback control loop further provides for automatic adjustment to the rate at which a drilling fluid is dispensed to the cutting head 42. HDDM controller 50 communicates the necessary control signals to the displacement pump 28, rotation pump 30, and liquid dispensing pump 58 to implement the LOCK-OUT and remote steering/remote control methodologies of the present invention.

The HDDM controller 50 is also coupled to a drill string clamp 61 and a clamp sensor. The HDDM controller 50 controls the drill string clamp 61 to immobilize the drill string during a LOCK-OUT procedure in which limited usage of the thrust/pullback pump 28 and rotation pump 30 is provided. The HDDM controller 50 activates the clamping mechanism during a LOCK-OUT procedure to prevent movement of the downhole drill string and, upon receiving a signal from a clamp sensor 53 verifying proper engagement between the clamp 61 and the drill string, the HDDM controller 50 permits limited thrust/pullback pump 28 and rotation pump 30 usage, such as when manipulating rods being added to or removed from the clamped drill string.

In FIG. 3B, there is illustrated an alternative embodiment of the present invention, in which control of the displacement pump 28 is provided through hydraulic control signals, rather than electrical control signals employed in the embodiment described hereinabove. In accordance with one mode of operation, the operator sets the rotation pump control 52 to an estimated optimum rotation setting for a drilling or reaming operation. The rotation pump control 52 transmits a control signal to a hydraulic displacement control ($HDC_R$) 72 which, in turn, transmits a hydraulic control signal to the rotation pump 30 for purposes of controlling the rotation rate of the cutting head or reamer 42.

Various types of hydraulic displacement controllers (HDC's) use hydraulic pilot signals for effecting forward and reverse control of the pump servo. A pilot signal is normally controlled through a pilot control valve by modulating a charge pressure signal typically between 0 and 800 pounds-per-square inch (psi). $HDC_R$ 72, in response to the operator changing the setting of the rotation pump control 52, produces corresponding changes to the forward pilot signal, $X_F$ 80, and the reverse pilot signal, $X_R$ 82, thus altering the rate of the rotation pump 30. Line $X_T$ 81 is a return line from $HDC_R$ 72 to the rotation pump control 52. Similarly, in response to the operator changing the setting of the displacement pump control 54, the displacement pump control 54 correspondingly alters the forward pilot signal, $Y_F$ 84, and the reverse pilot signal, $Y_R$ 86, of $HDC_D$ 74, which controls the displacement pump 28, thus altering the displacement rate. Line $Y_T$ 85 is a return line from $HDC_D$ 74 to the displacement pump control 54.

The hydraulic sensor/controller 73 senses the pressure of the rotation pump 30 or, alternatively, the rotation speed of the rotation pump 30, by monitoring the flow rate through an orifice to measure rotation, and is operable to transmit hydraulic override signals $X_{OF}$ 88 and $X_{OR}$ 90 to the $HDC_R$ 72, and hydraulic override signals $Y_{OF}$ 89 and $Y_{OR}$ 91 to the $HDC_D$ 74. When, for example, the hydraulic sensor/controller 73 senses that the pressure of the rotation pump 30 has exceeded the upper acceptable pressure limit, $P_L$, override signals $Y_{OF}$ 89 and $Y_{OR}$ 91 are transmitted to the $HDC_D$ 74 in order to appropriately reduce the cutting head or reamer displacement rate while maintaining the rotation of the cutting head or reamer at a desired rate, such as a substantially constant rate. Once the pressure of the rotation pump 30 has recovered to an acceptable level, the hydraulic sensor/controller 73 instructs $HDC_D$ 74 to increase the displacement rate.

The hydraulic sensor/controller 73 may be coupled to an HDDM controller of the type described in connection with FIG. 3A or, alternatively, may incorporate the functionality of HDDM controller 50. In an embodiment in which limited rotation and displacement pump usage is provided during implementation of a LOCK-OUT procedure, the hydraulic sensor/controller 73 or HDDM controller coupled thereto controls the drill string clamp 61 and receives signals from the clamp sensor 63 in a manner described previously with regard to the embodiment of FIG. 3A.

Figure 4:
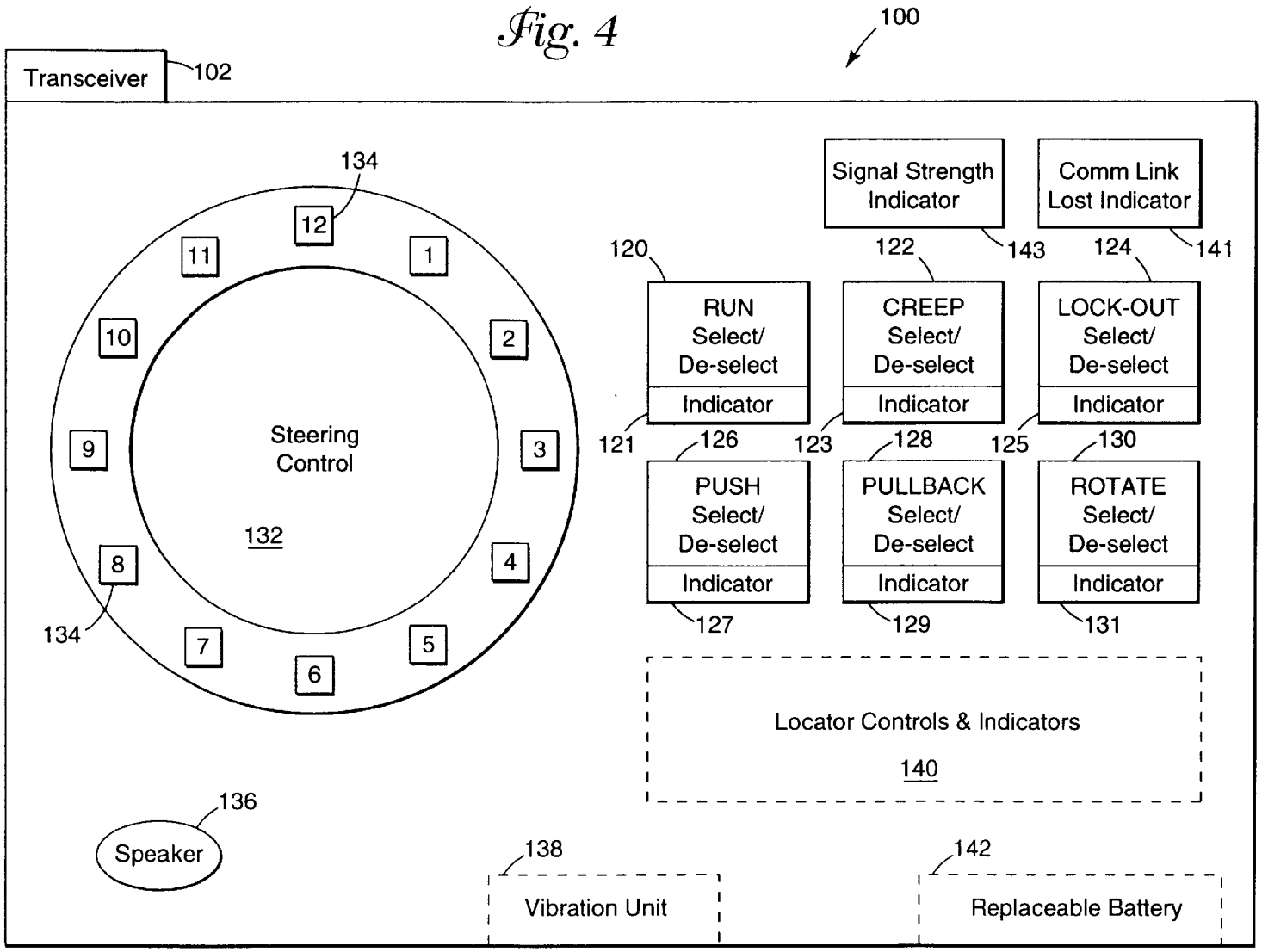
FIG. 4 is a block diagram of a remote unit that cooperates with a controller of an HDD machine to implement a remote LOCK-OUT methodology in accordance with an embodiment of the present invention.

Turning now to FIG. 4, there is illustrated a remote unit 100 according to an embodiment of the present invention. Remote unit 100 shown in FIG. 4 includes a number of user actuatable controls for selecting and de-selecting a variety of remote control functions. As previously discussed, remote unit 100 may alternatively be incorporated into a portable locator. According to an alternative configuration, various locator controls and indicators 140 may instead be incorporated as part of remote unit 100.

In general, a remote user may use remote unit 100 to implement a LOCK-OUT methodology according to the present invention exclusive of or in addition to other remote control capabilities. In one system configuration, for example, remote unit 100 includes only those controls and indicators necessary to perform LOCK-OUT functions (e.g., LOCK-OUT control 124, LOCK-OUT indicator 125, RUN control 120, RUN indicator 121, and COMM LINK LOST indicator 141).

A user initiates the LOCK-OUT procedure by actuation of LOCK-OUT control 124. A LOCK-OUT indicator 125 provides a visual indication of the LOCK-OUT procedure status, such as the selection or de-selection of LOCK-OUT control 124 and verification that the LOCK-OUT sequence has been successfully completed by the HDD machine. In one embodiment, LOCK-OUT control 124 includes a mushroom-type push button switch incorporating a twist release mechanism and a key cap. According to this embodiment, LOCK-OUT indicator 125 includes a red illumination element, such as a lamp or light emitting diode (LED), for example, which may be controlled in a constant illumination mode, flashing mode, and extinguished mode.

According to a second system configuration, remote unit 100 may, in addition to the controls and indicators of the first system configuration discussed above, further include a CREEP mode control 122 and associated CREEP indicator 123. By actuation of CREEP control 122, the remote user may place the HDD machine into a "CREEP" mode. When placed in CREEP mode, the thrust or displacement rate of the drill string/boring tool is reduced to a user defined low speed level. In one embodiment, the remote user may modify the creep rate of boring tool displacement by adjustment of a CREEP SPEED control (not shown). It is noted that, upon proper termination of the CREEP mode of operation, the HDD machine operator must return the manual thrust/pullback control to a "neutral" position before resuming normal thrust/pullback operations.

A CREEP mode of operation may be selected by the remote user actuating CREEP control 122. In one embodiment, CREEP control 122 includes a pushbutton-type toggle switch which may incorporate an illumination element as an indicator 123 to indicate the state of CREEP control 122. For example, CREEP control 122 may include a yellow-lighted pushbutton-type toggle switch. Normal drilling operations may be remotely reinstated by appropriate termination of CREEP mode and actuation of RUN control 120. RUN control 120 may include a pushbutton-type toggle switch and associated green-colored illumination element 121.

In accordance with a third system configuration, remote unit 100 may, in addition to the controls and indicators of the first and second system configurations discussed above, also provide the capability to send steering requests/commands to the HDD machine via steering control 132. Remote unit 100 includes a steering control 132 that permits the remote user to remotely effect steering changes to the heading of the boring tool.

In one embodiment, steering control 132 includes 12 lighted (e.g., white) pushbutton momentary switches 134 that define a clock-face pattern. When pushed, a selected switch 134 illuminates and all other switches 134 are extinguished. When certain other remote control functions are evoked, such as functions initiated by actuation of ROTATE control 130 or PULLBACK control 128, for example, all switches 134 of steering control 132 are extinguished and steering control 132 is disabled.

When the remote user desires that the boring tool be steered a certain direction, such as toward a 2 o'clock direction from a 12 o'clock direction, for example, an appropriate momentary switch 134 (e.g., "2" o'clock switch 134) is actuated by the remote user to select the desired clock-based steering direction. In accordance with one steering mode embodiment, actuation of a selected momentary switch 134 results in the transmission of a steering signal from transceiver 102 of remote unit 100. The steering signal is received by the transceiver 55 of the HDD machine 20, shown in FIG. 2, and presented on display 34. An RS-232 interface may be provided between the HDDM controller 50 and display 34. A replication of the steering control clock-face of the remote unit 100 may, for example, be graphically presented on display 34 of the HDD machine. The HDD machine operator may make the necessary adjustments at the HDD machine to effect the requested steering changes.

According to an alternative embodiment, the steering signal transmitted by remote unit 100 is received at the HDD machine and acted upon directly by HDDM controller 50, rather than by the machine operator, via the closed-loop control system of the HDD machine. The steering request/command made by the remote user may be displayed on the HDD machine display 34 in the manner described above. The machine operator may, if desired, override, suspend or terminate an automatic steering operation initiated by the remote user.

The remote user may control other HDD operations, including controlling forward and reverse displacement of the drill string/boring tool and rotation of the drill string/boring tool. Remote control over these three operations is initiated by actuation of a PUSH control 126, PULLBACK control 128, and ROTATE control 130, respectively. Selection and de-selection of each of these controls 126, 128, 130 results in illumination and extinguishing of associated PUSH, PULLBACK, and ROTATE indicators 127, 129, and 131, respectively. In accordance with one embodiment, PUSH control 126 is associated with white PUSH indicator 127, PULLBACK control 128 is associated with blue PULLBACK indicator 129, and ROTATE control 130 is associated with blue ROTATE indicator 131.

Remote unit 100 further includes a COMM LINK LOST indicator 141 which is illuminated whenever a loss of communication connectivity between the remote unit 100 and HDD machine is detected. Remote unit 100 may also include a signal strength indicator 143. A multiple colored indicator 143, for example, may be used to indicate the relative strength of the signal transmitted between HDD machine and remote unit 100. For example, the signal strength indicator 143 may provide for the generation of green light, yellow light, and red light. Illumination of a green light, for example, may indicate reception of a strong signal (e.g., high signal-to-noise (SNR) ratio). Illumination of a yellow light may be indicative of an acceptable but reduced signal strength level. Illumination of a red light may be indicative of an unacceptable signal strength level. Frequent illumination of the yellow and/or red lights may indicate that repeaters should be deployed in order to increase the strength of the signal transmitted between the remote unit 141 and HDD machine.

Audible warnings or alert messages, both verbal and non-verbal, may be broadcast to the remote user via a speaker 136 provided on the remote unit 141. The speaker preferably broadcasts audible messages at an appropriate level, but no louder than is permitted under applicable regulations (e.g., no greater than 106 Dba) A vibration unit 138 may also be provided to communicate a tactile warning or alert message to the remote user. The remote unit 100 is powered by a battery 142 that can be readily replaced in the field, preferably without the need for tools. The battery is preferably a rechargeable battery.

Figure 5:
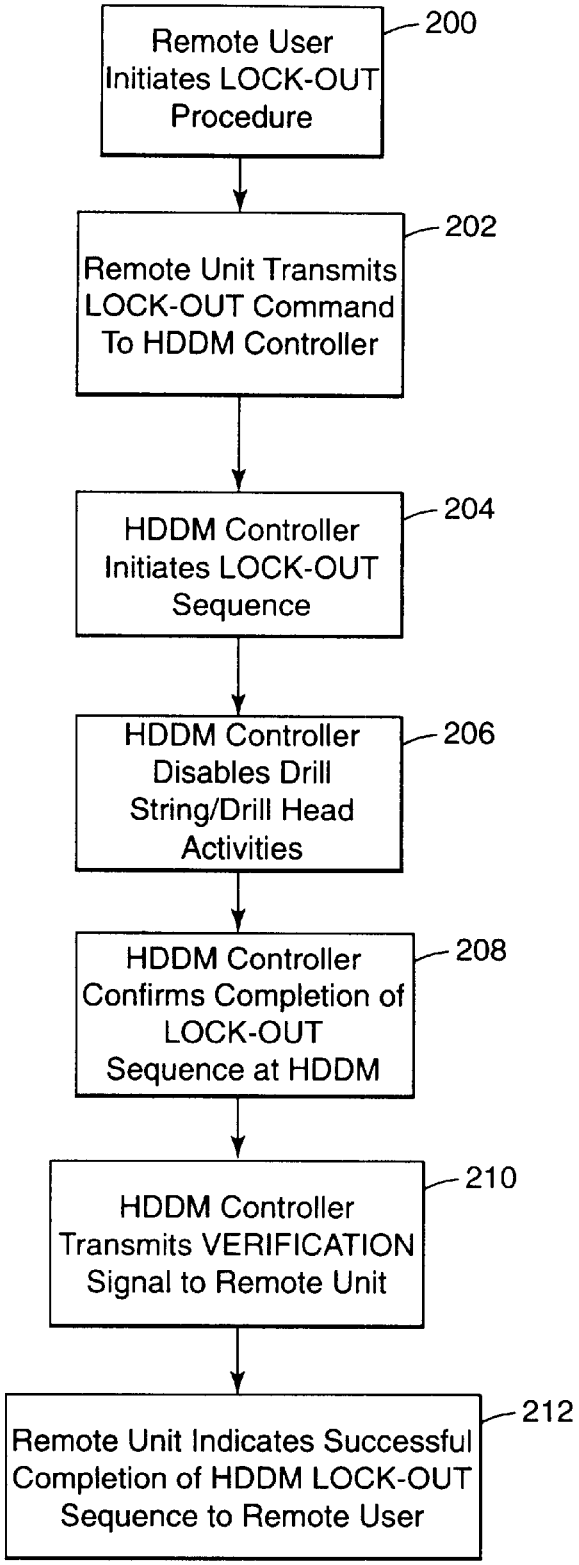
FIG. 5 is a flow diagram that illustrates various steps associated with cooperative operation between a remote unit and a controller of an HDD machine when implementing a remote LOCK-OUT methodology in accordance with an embodiment of the present invention.

Referring now to FIG. 5, there is illustrated a flow diagram that illustrates various steps associated with cooperative operation between a remote unit and a controller of an HDD machine when implementing a remote LOCK-OUT methodology in accordance with an embodiment of the present invention. The remote unit turns on whenever the remote user actuates either the LOCK-OUT control or the RUN control. The LOCK-OUT procedure is initiated 200 in the field by a remote user, such as a user situated down-hole of the HDD machine, using the remote unit described hereinabove. The remote unit transmits 202 a LOCK-OUT command to the HDDM controller. In response to the LOCK-OUT command, the HDDM controller initiates 204 a LOCK-OUT sequence locally at the HDD machine.

In general terms, the HDDM controller disables 206 drill string/cutting head activities when implementing the LOCK-OUT sequence. The HDDM controller confirms 208 successful completion of the LOCK-OUT sequence at the HDD machine. After confirming successful completion of the LOCK-OUT sequence, the HDDM controller transmits 210 a VERIFICATION signal (e.g., "COMMAND-ACKNOWLEDGED" signal) to the remote unit. In response to receipt of the VERIFICATION signal, the remote unit provides 212 an indication to the remote user that the LOCK-OUT sequence at the HDD machine has been successfully completed.

Figure 6:
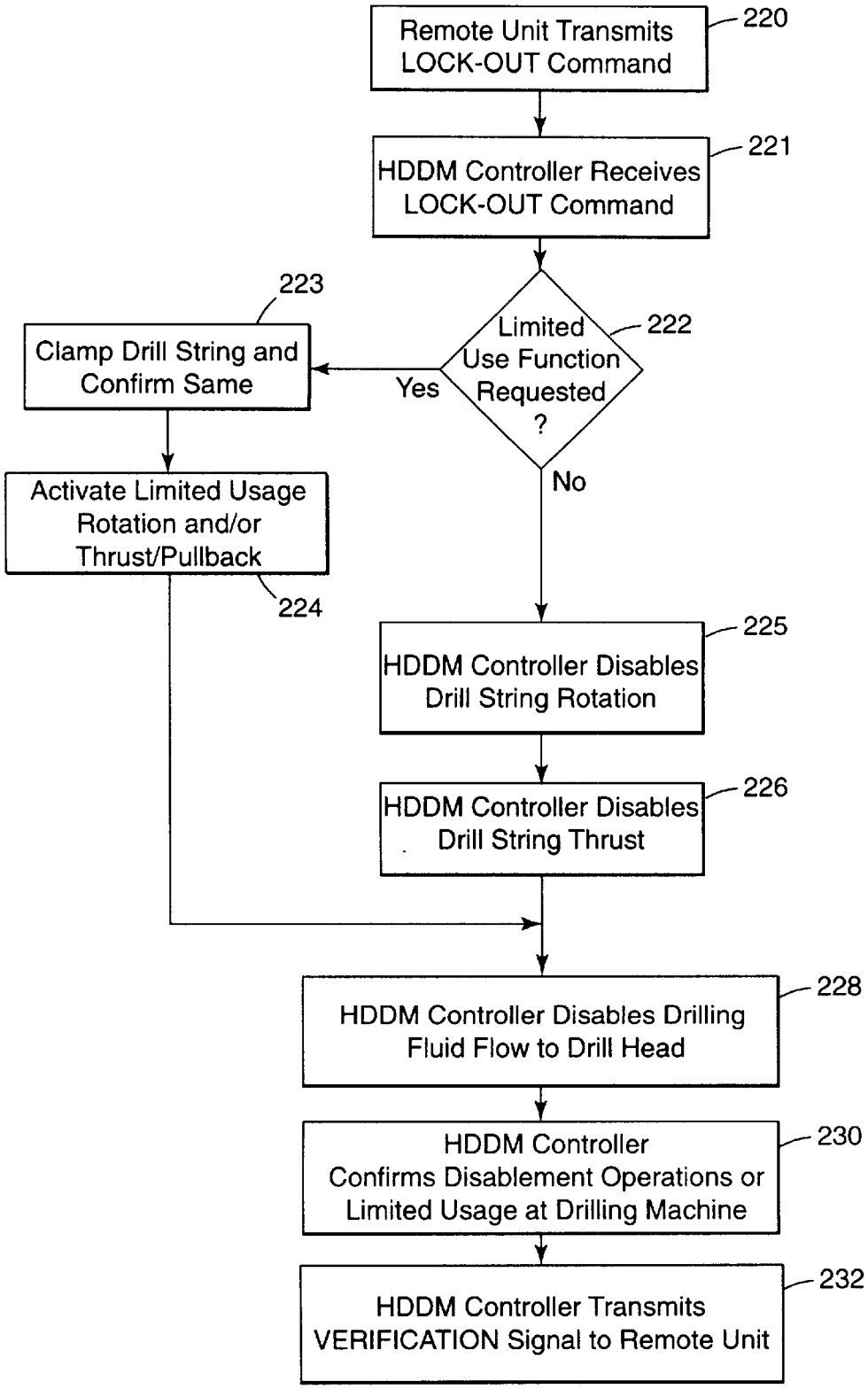
FIG. 6 is a flow diagram that illustrates various steps of a remote LOCK-OUT methodology implemented by a controller of an HDD machine in accordance with an embodiment of the present invention.

FIG. 6 is a flow diagram that illustrates various steps of a remote LOCK-OUT methodology implemented by a controller of an HDD machine in accordance with an embodiment of the present invention. According to this embodiment, a limited set of drilling machine functions may be made available as part of the LOCK-OUT procedure. The LOCK-OUT sequence, as discussed above, is initiated by the remote unit transmitting 220 a LOCK-OUT command to the HDD machine. The HDDM controller receives 221 the LOCK-OUT command and, in response, performs a number of operations to prevent all drill string/cutting head or reamer movement and, if requested, allows for limited usage of the driving apparatus.

If limited usage of the driving apparatus is requested 222 by the machine operator, then the drill string is clamped 223 to prevent all downhole drill string movement. Confirmation 223 of drill string immobilization received from a sensor at the clamping mechanism is required before limited usage of the driving apparatus is permitted. After receiving a confirmation signal from the clamp mechanism sensor, the HDDM controller provides 224 for limited usage of the rotation and thrust/pullback facilities of the drilling machine to perform certain desired tasks, such as rod manipulation. If limited usage of the driving apparatus is not requested 222, the HDDM controller disables drill string rotation 225 and also disables 226 drill string displacement or thrust.

The HDDM controller further disables 228 drilling fluid flow into the borehole, such as drilling fluid supplied to the cutting head via the drill string. This operation is of particular importance in applications where a high-pressure fluid dispensing capability at the cutting head is utilized. For example, fluid pressures on the order of 1,200 psi (pounds per square inch) at the fluid dispensing nozzle at the cutting head are common. Further, many available fluid dispensing units pump fluid through the drill string/cutting head at 200 gallons per minute. Those skilled in the art readily appreciate the importance of terminating the delivery of fluid to the cutting head as part of a comprehensive and effective LOCK-OUT methodology.

The HDDM controller confirms 230 that all drilling operations have been successfully disabled, such as drill string rotation, displacement, and fluid delivery to the cutting head, and, if applicable, that a limited usage mode of operation has been enabled (e.g., rod manipulation mode is enabled). The HDDM controller then transmits 232 a VERIFICATION signal to the remote unit.

Figure 7:
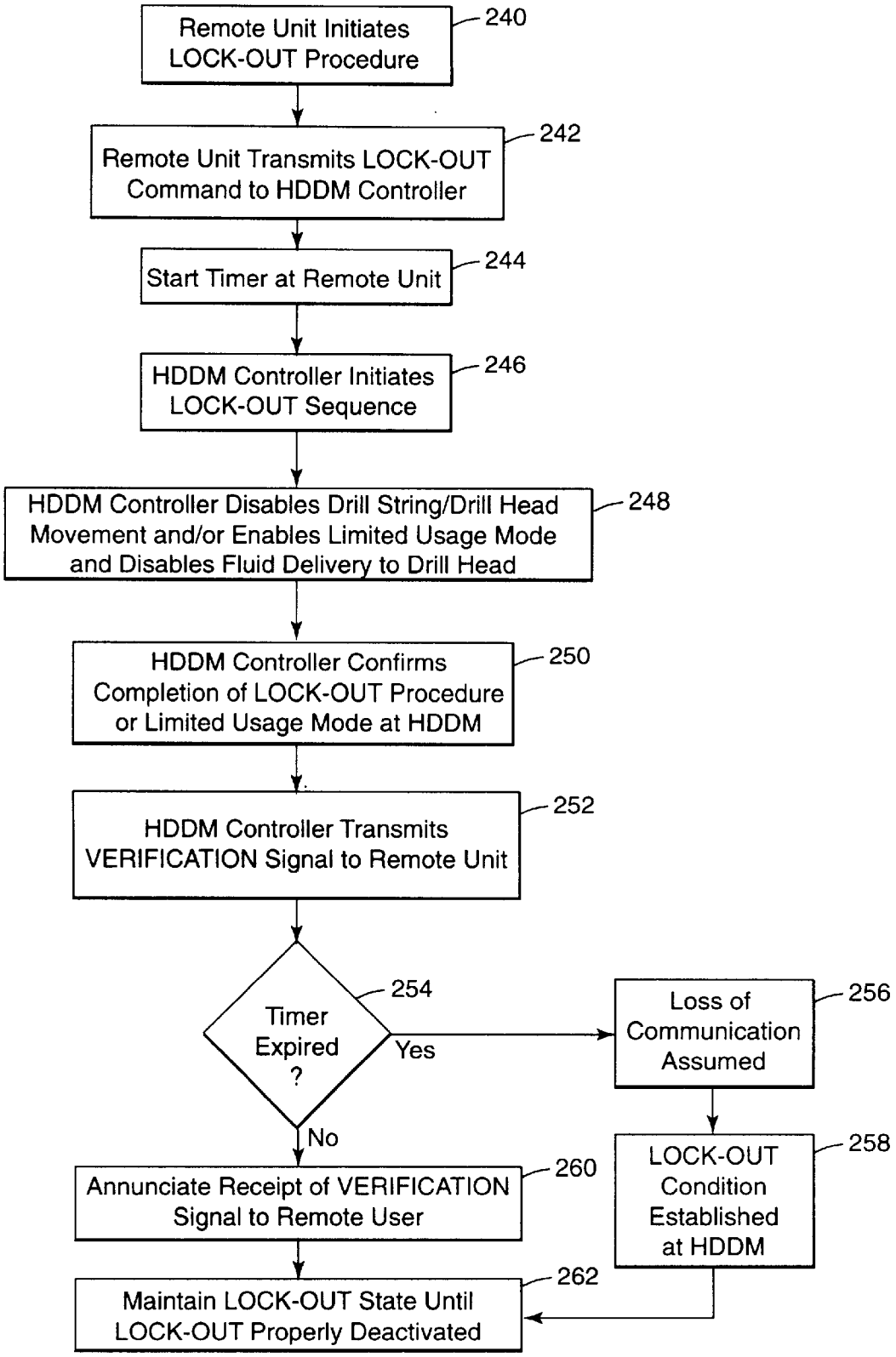
FIG. 7 is a flow diagram that illustrates various steps associated with cooperative operation between a remote unit and an HDD machine controller when implementing a remote LOCK-OUT methodology in accordance with another embodiment of the present invention.

FIG. 7 is a flow diagram that illustrates various steps associated with cooperative operation between a remote unit and an HDD machine controller when implementing a remote LOCK-OUT methodology in accordance with another embodiment of the present invention. According to this embodiment, the remote user initiates 240 the LOCK-OUT procedure using the remote unit, and, in response, the remote unit transmits 242 a LOCK-OUT command to the HDDM controller. A timer is started 244 at the remote unit upon transmitting 242 the LOCK-OUT signal to the HDDM controller. The timer is used to determine whether or not the LOCK-OUT procedure has been successfully completed with a predetermined time period, such as three seconds for example.

The HDDM controller initiates 246 the LOCK-OUT sequence in response to receipt of the LOCK-OUT command and performs the necessary operations to disable 248 drill string/cutting head movement and fluid delivery to the cutting head and, if applicable, enables limited usage of the rotation and/or thrust/pullback facilities of the drilling machine. The HDDM controller confirms 250 completion of the LOCK-OUT procedure or activation of a limited usage mode at the HDD machine and transmits 252 a VERIFICATION signal to the remote unit.

If the timer at the remote unit has not expired 254 when the VERIFICATION signal is received by the remote unit, successful receipt of the VERIFICATION signal is annunciated 260 to the remote user. The LOCK-OUT state is maintained 262 until the LOCK-OUT condition is properly deactivated.

If the timer at the remote unit has expired 254 when the VERIFICATION signal is received by the remote unit or if no VERIFICATION signal is received at all, a loss of communication between the remote unit and the HDD machine is assumed 256 and a LOCK-OUT condition is established 258 at the HDD machine. The LOCK-OUT state is maintained 262 at the HDD machine until the LOCK-OUT condition is properly deactivated.

Figure 8:
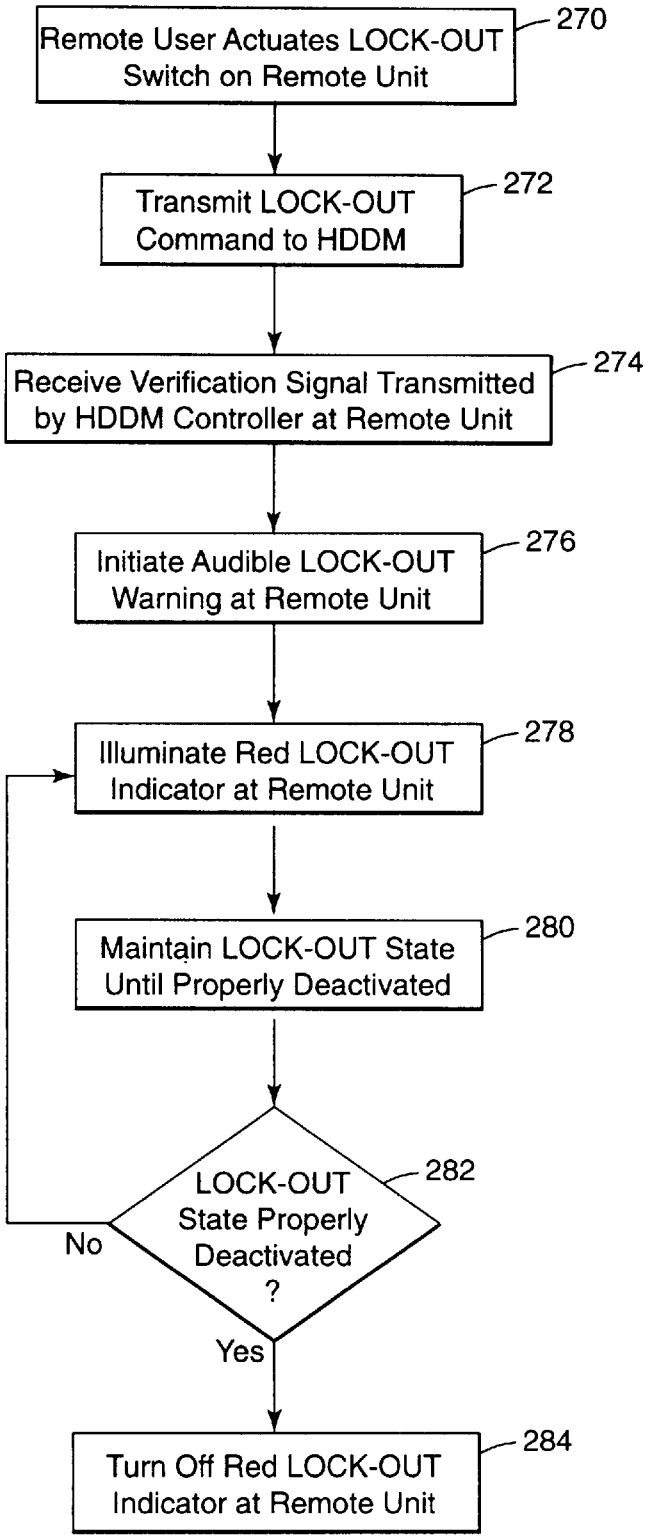
FIG. 8 is a flow diagram that illustrates various other steps of a remote LOCK-OUT methodology implemented by a remote unit in accordance with an embodiment of the present invention.

FIG. 8 is a flow diagram that illustrates various other steps of a remote LOCK-OUT methodology implemented by a remote unit in accordance with another embodiment of the present invention. According to this embodiment, the remote user actuates a LOCK-OUT switch on the remote unit 270 to initiate the LOCK-OUT sequence. The LOCK-OUT command is transmitted 272 by the remote unit. After the HDD machine successfully completes the LOCK-OUT sequence, the HDDM controller transmits a VERIFICATION signal which is received 274 by the remote unit. In response to receiving the VERIFICATION signal, the remote unit initiates 276 an audible LOCK-OUT response, such as a series of short beeps or a verbal LOCK-OUT message, for example.

A red LOCK-OUT indicator is also illuminated 278 on the remote unit as an indication to the remote user that the HDD machine is operating in a LOCK-OUT mode. Assuming that the remote user wishes to discontinue the LOCK-OUT condition, and properly deactivates 282 the LOCK-OUT mode in cooperation with the HDD machine operator, the red LOCK-OUT indicator is extinguished 284 on the remote unit and any audible LOCK-OUT warning broadcast by the remote unit is terminated. If the LOCK-OUT state is not properly deactivated, illumination of the red LOCK-OUT indicator is continued 278 at the remote unit and the LOCK-OUT state at the HDD machine is maintained 280. The audible LOCK-OUT warning may also be re-broadcast to the remote user.

Figure 9:
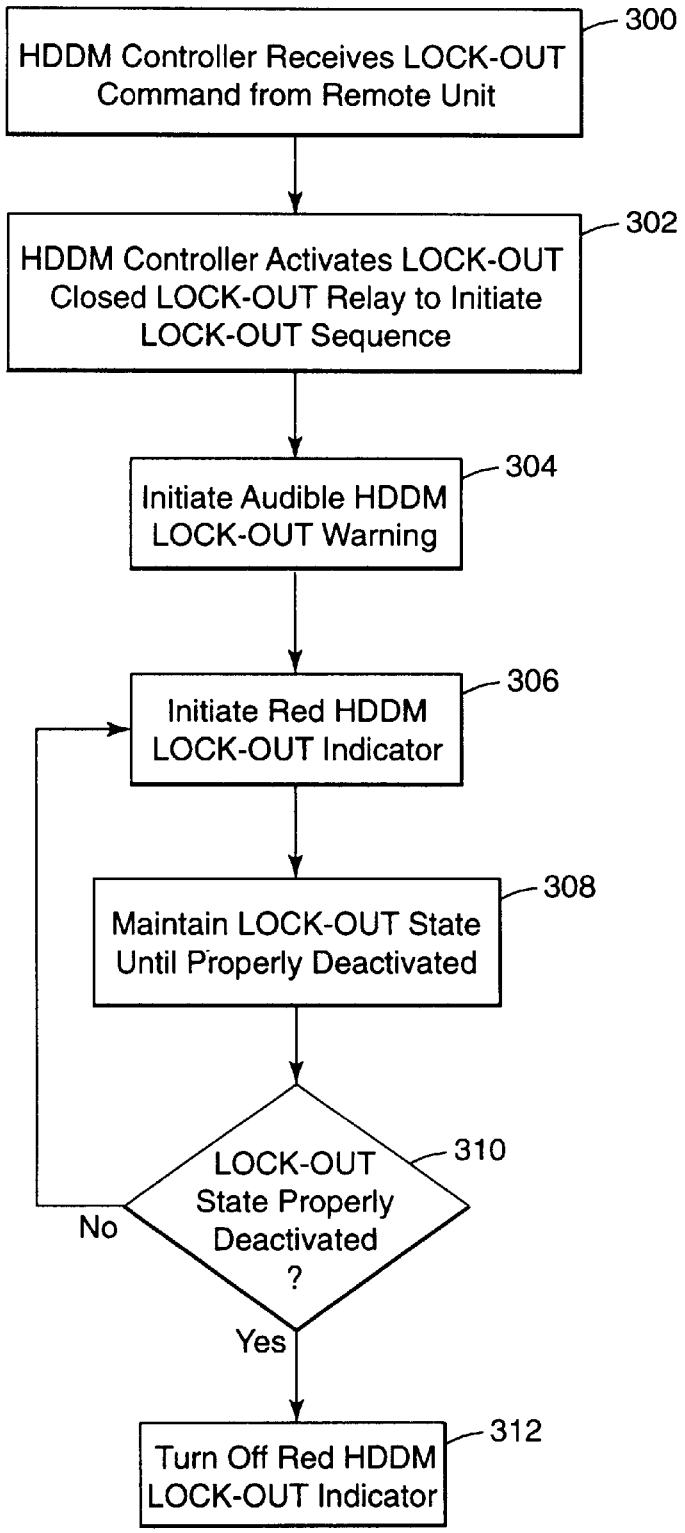
FIG. 9 is a flow diagram that illustrates various other steps of a remote LOCK-OUT methodology implemented by a controller of an HDD machine in accordance with an embodiment of the present invention.

FIG. 9 is a flow diagram that illustrates various other steps of a remote LOCK-OUT methodology implemented by a controller of an HDD machine in accordance with another embodiment of the present invention. According to the embodiment of FIG. 9, the HDDM controller receives 300 a LOCK-OUT command from the remote unit and, in response, activates a normally closed LOCK-OUT output to initiate the LOCK-OUT sequence 302. In its non-activated or normal state, the LOCK-OUT output remains deactivated, thereby assuring that a LOCK-OUT condition is maintained at the HDD machine should a power failure or LOCK-OUT sequence execution error occur at the HDD machine. To deactivate the LOCK-OUT state at the HDD machine, each of the steps constituting the LOCK-OUT sequence must be successfully implemented and verified as being successfully completed.

In response to the HDDM controller initiating the LOCK-OUT sequence 302, an audible LOCK-OUT warning is broadcast 304 at the HDD machine to alert the HDD machine operator that the HDD machine is operating in the LOCK-OUT mode. The audible warning may comprise, for example, three short beeps (e.g., 0.5 seconds ON and 0.5 seconds OFF) followed by a one second pause. This sequence of audible beeps may be repeated multiple times, such as three times. A red indicator at the HDD machine is also illuminated 306. The LOCK-OUT state is maintained 308 and the red indicator remains illuminated on the HDD machine until the LOCK-OUT mode is properly deactivated. When the LOCK-OUT state is properly deactivated 310, the red LOCK-OUT indicator on the HDD machine is extinguished 312 and any audible LOCK-OUT warning is terminated.

Figure 10:
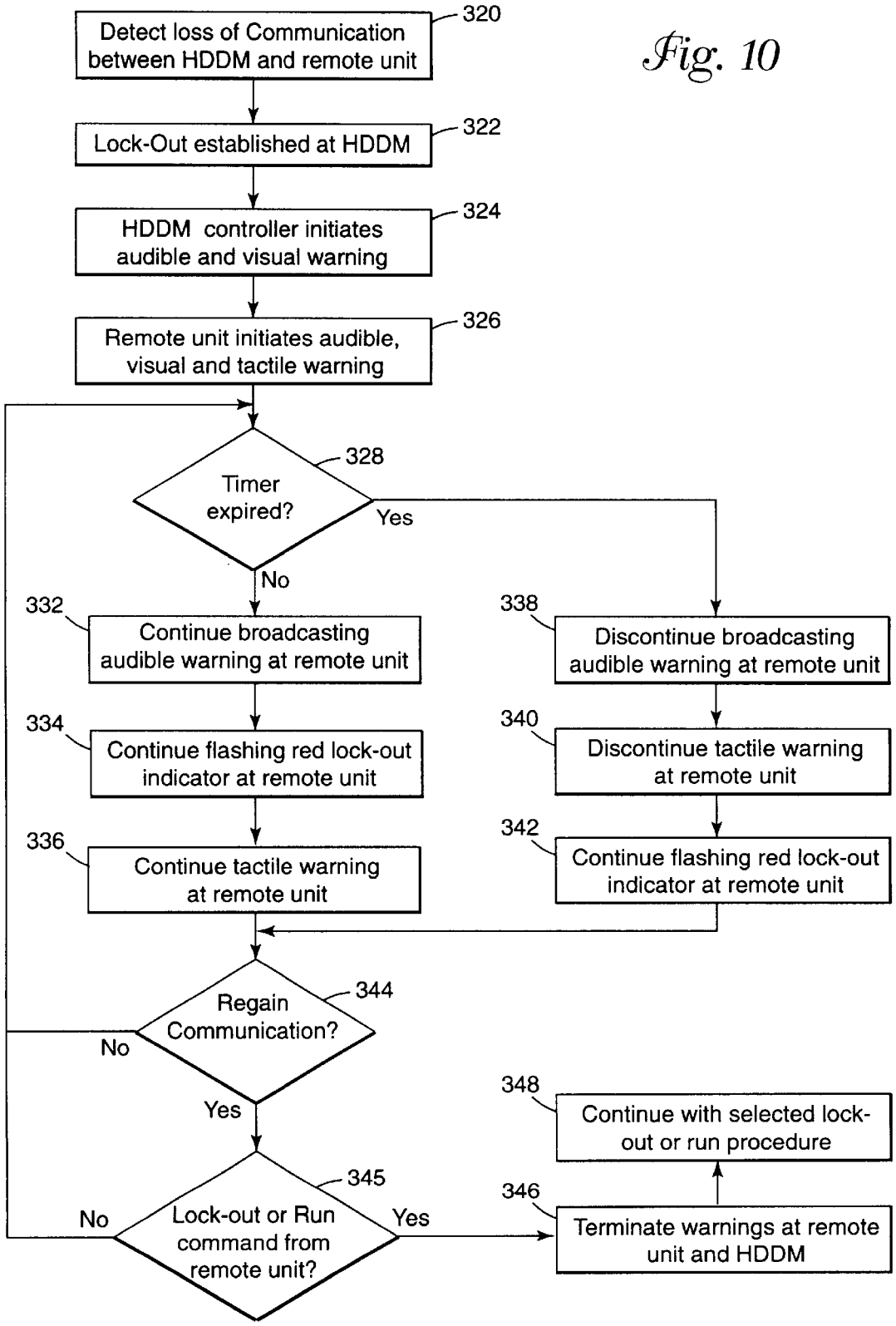
FIG. 10 is a flow diagram that illustrates various steps associated with cooperative operation between a remote unit and an HDD machine controller in response to a loss of communication connectivity therebetween in accordance with an embodiment of the present invention.

FIG. 10 is a flow diagram that illustrates various steps associated with cooperative operation between a remote unit and an HDD machine controller in response to a loss of communication connectivity between the remote unit and HDD machine in accordance with an embodiment of the present invention. A loss of communication connectivity is detected 320 between the remote unit and HDD machine. A loss of communication condition may arise in several contexts, such by receipt of an HDD machine signal of unacceptable strength or by the expiration of a countdown or countup timer at the remote unit as previously discussed, for example.

Various other signaling schemes known in the art may be employed to detect the occurrence of a loss of communication condition arising between the remote unit and the HDD machine. For example, a handshaking or polling signaling scheme may be employed by which signals are transmitted between the remote unit and the HDD machine on a periodic basis. The strength or quality of a received signal may be analyzed. For example, the remote unit may evaluate the SNR of a polling signal transmitted by the HDD machine and determine if the SNR of the received signal is adequate.

If a loss of communication connectivity between the remote unit and HDD machine is detected 320, the HDDM controller initiates 322 the LOCK-OUT sequence to transition the HDD machine to a LOCK-OUT mode of operation. A timer is activated upon detection of the loss communication connectivity between the remote unit and the HDD machine. It is noted that the engine of the HDD machine remains operating during and after establishing a LOCK-OUT condition at the HDD machine. The HDDM controller initiates 324 an audible and/or visual warning indicative of the loss of communication condition.

If the timer has not yet expired 328, the remote unit continues broadcasting 332 an audible warning and continues flashing 334 a red LOCK-OUT indicator at the remote unit. The remote unit continues providing 336 a tactile warning 326 to alert the remote user to the loss of communication condition. The audible and tactile warnings may, for example, comprise a continuous tone or vibration that continues for one minute or until other events discussed below occur. When the timer expires 328, broadcasting of the audible warning is discontinued 338. Provision of the tactile warning is also discontinued 340 upon expiration of the timer. The red LOCK-OUT indicator, however, remains flashing 342 at the remote unit to alert the operator as to the continuance of the LOCK-OUT mode of operation during the loss of communication condition.

The above-described warning sequence is repeated until communication connectivity is regained 344 between the remote unit and the HDD machine or until a LOCK-OUT or RUN command transmitted by the remote unit is received 345 and successfully processed by the HDD machine. Upon the occurrence of either of these events 344, 345, the audible, visual, and/or tactile warnings are terminated 346 at the remote unit and at the HDD machine, and the selected LOCK-OUT or RUN procedure is continued.

Figure 11:
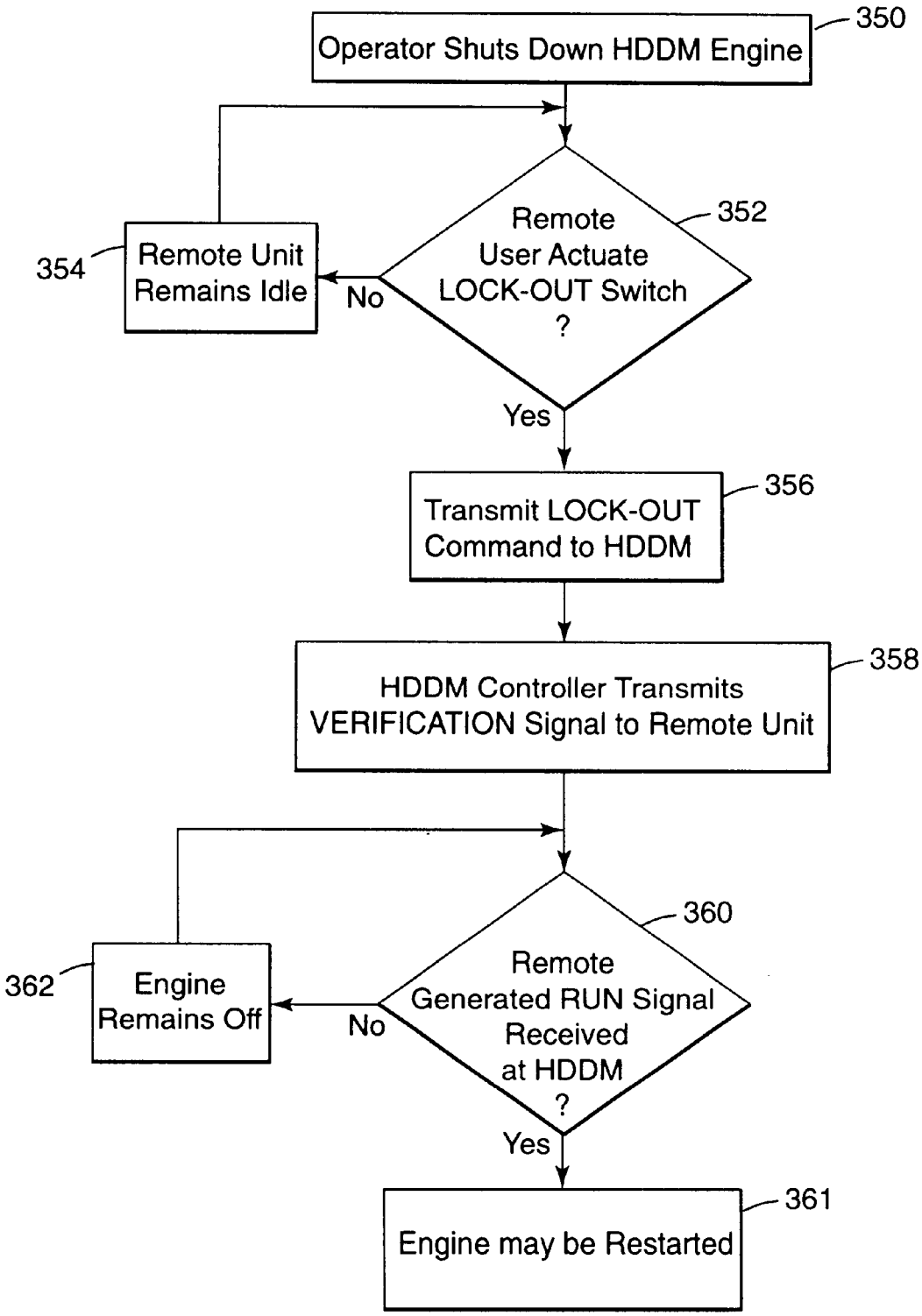
FIG. 11 is a flow diagram that illustrates various steps associated with cooperative operation between a remote unit and an HDD machine controller in response to an HDD machine engine shut-down condition in accordance with an embodiment of the present invention.

FIG. 11 is a flow diagram that illustrates various steps associated with cooperative operation between a remote unit and an HDD machine controller in response to an HDD machine engine shut-down condition in accordance with an embodiment of the present invention. According to this embodiment, it is assumed that the engine of the HDD machine is shut down 350 by the operator or by some other process. It is further assumed that all movement of the drill string/cutting head or reamer ceases soon after the engine of the HDD machine shuts down. The remote unit remains idle 354 until such time as the remote user attempts to actuate the LOCK-OUT control.

When the remote user actuates the LOCK-OUT control 352 during the time in which the HDD machine engine is shut down, the remote unit transmits 356 a LOCK-OUT command to the HDD machine. The HDDM controller transmits 358 a VERIFICATION signal to the remote unit indicating that a LOCK-OUT condition is maintained at the HDD machine, as is the case when the engine is shut down. The operator of the HDD machine will not be able to start the HDD machine engine 362 until the remote operator depresses the RUN control on the remote unit. If 360 the RUN signal is received by the HDD machine, the engine may be re-started 361 by the HDD machine operator.

Figure 12:
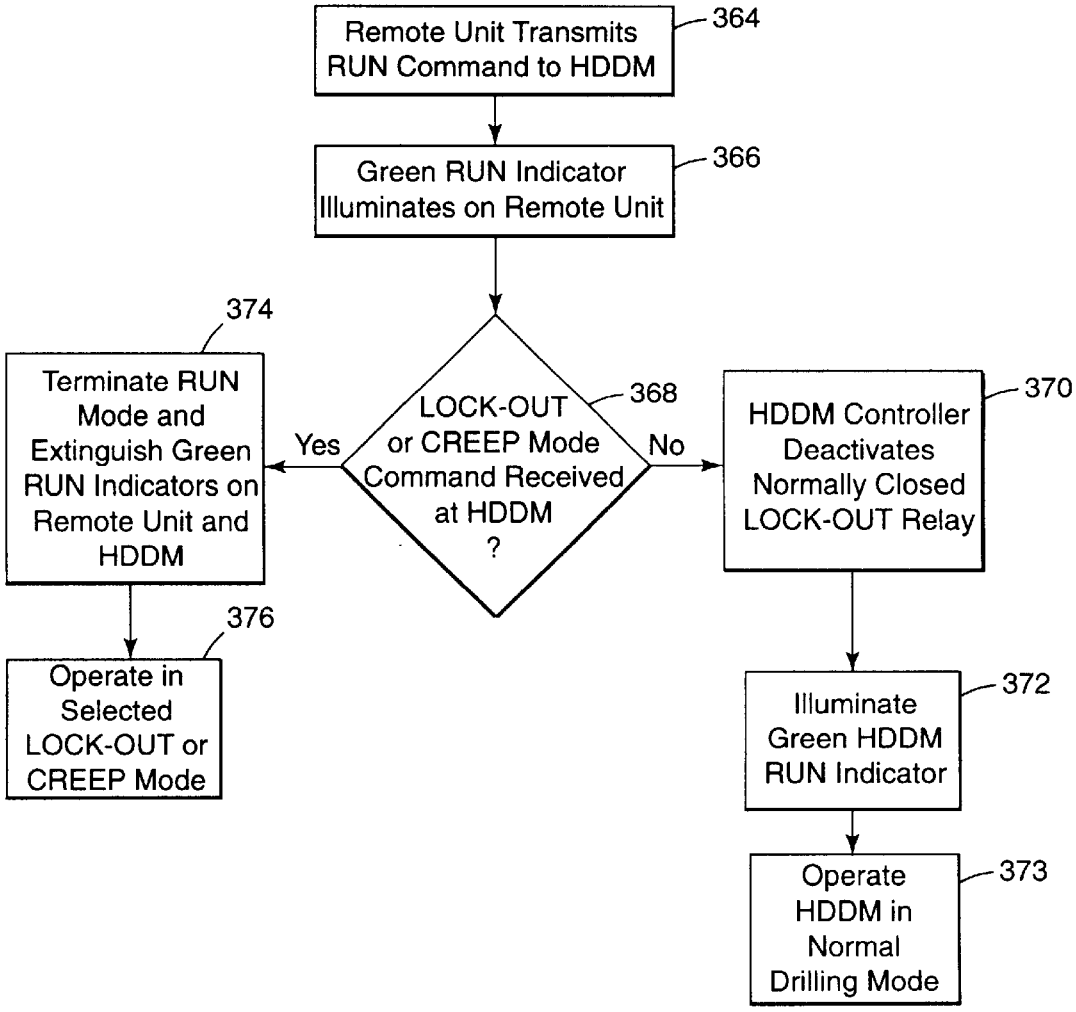
FIG. 12 is a flow diagram that illustrates various steps associated with cooperative operation between a remote unit and an HDD machine controller when operating in a RUN mode according to an embodiment of the present invention.

FIG. 12 is a flow diagram that illustrates various steps associated with cooperative operation between a remote unit and an HDD machine controller when operating in a RUN mode according to an embodiment of the present invention. The remote unit transmits 364 a RUN command to the HDD machine in response to user actuation of the RUN control at the remote unit. A green RUN indicator is illuminated 366 on the remote unit. The green RUN indicator will remain illuminated until such time as the remote user actuates either the LOCK-OUT control or the CREEP control. If 368 a LOCK-OUT or CREEP mode signal is not received at the HDD machine, the HDDM controller deactivates 370 the normally closed LOCK-OUT output and illuminates 372 the green HDD machine RUN indicator. The HDD machine may then be operated 373 in a normal drilling mode.

If 368 a LOCK-OUT or CREEP mode signal is received at the HDD machine, the HDDM controller terminates 374 the RUN mode and extinguishes the green HDD machine RUN indicator. The HDD machine operates 376 in the selected LOCK-OUT or CREEP mode.

Figure 13:
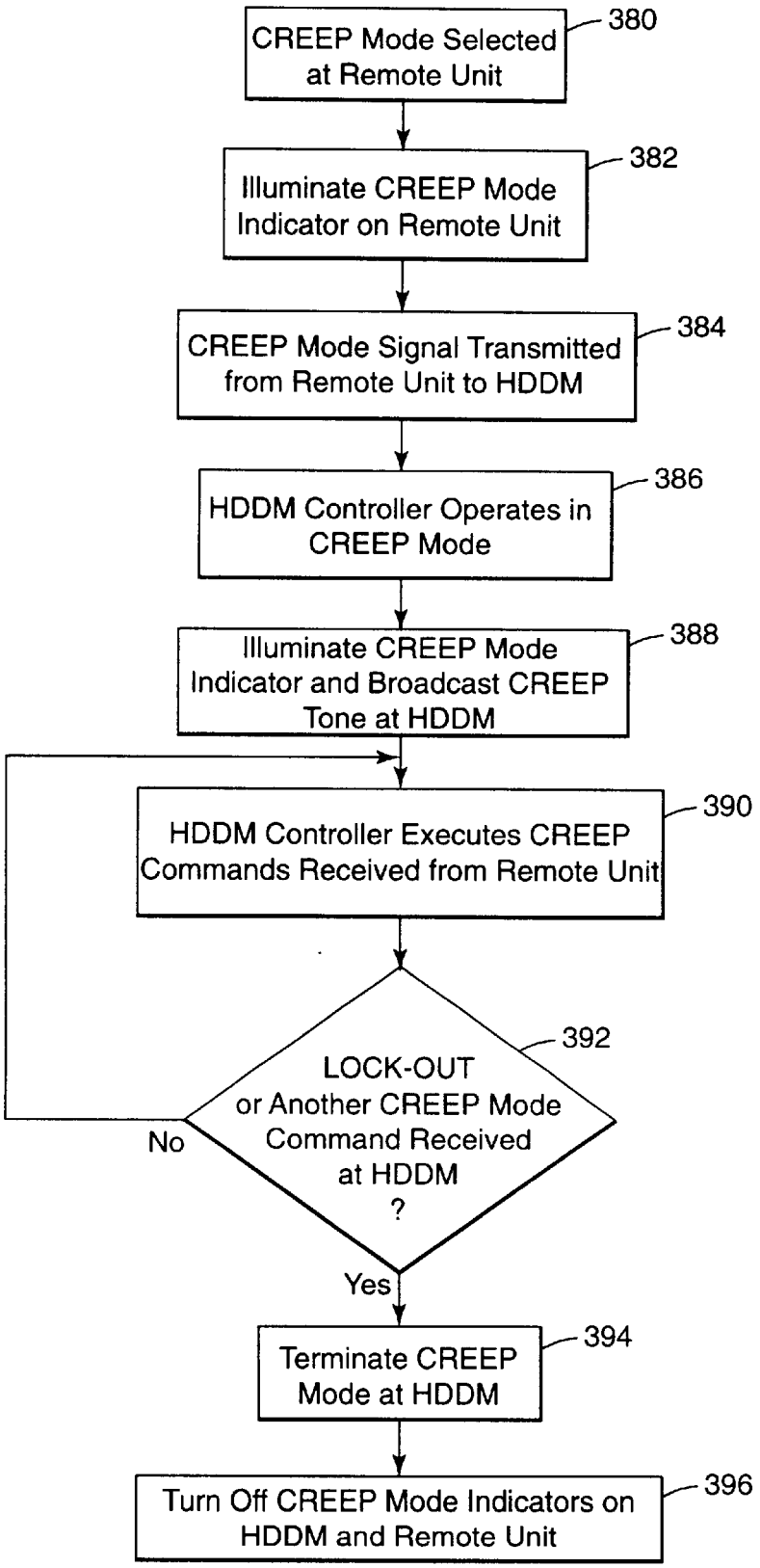
FIG. 13 is a flow diagram that illustrates various steps associated with cooperative operation between a remote unit and an HDD machine controller when operating in a CREEP mode according to an embodiment of the present invention.

FIG. 13 is a flow diagram that illustrates various steps associated with cooperative operation between a remote unit and an HDD machine controller when operating in a CREEP mode according to an embodiment of the present invention. A remote user initiates the CREEP mode of operation by actuating 380 the CREEP control on the remote unit. The CREEP mode indicator illuminates 382 on the remote unit and a CREEP mode signal is transmitted 384 from the remote unit to the HDD machine.

Upon receipt of the CREEP mode signal, the HDD machine 386 transitions to operation in the CREEP mode. A CREEP mode indicator is illuminated 388 on the HDD machine and an audible CREEP tone is broadcast. The CREEP tone may comprise a tone that is repeated every other second while the CREEP mode is active. The HDDM controller executes 390 CREEP commands received from the remote unit until such time as a LOCK-OUT signal or another CREEP mode signal is received at the HDD machine. If 392 either a LOCK-OUT signal or a subsequent CREEP mode signal is received at the HDD machine, the CREEP mode of operation is terminated 394 at the HDD machine, and the CREEP mode indicators/tones are extinguished 396 on the HDD machine and the remote unit.

FIGS. 14–17 are flow diagrams that illustrates various steps associated with cooperative operation between a remote unit and an HDD machine controller when operating in various remote operating and steering modes which may be selected 400 by user actuation of an appropriate control provided on the remote unit. The remote operating/steering modes depicted in FIGS. 14–17 include a ROTATE, PUSH, PULLBACK, and clock-based steering mode, respectively.

Figure 14:
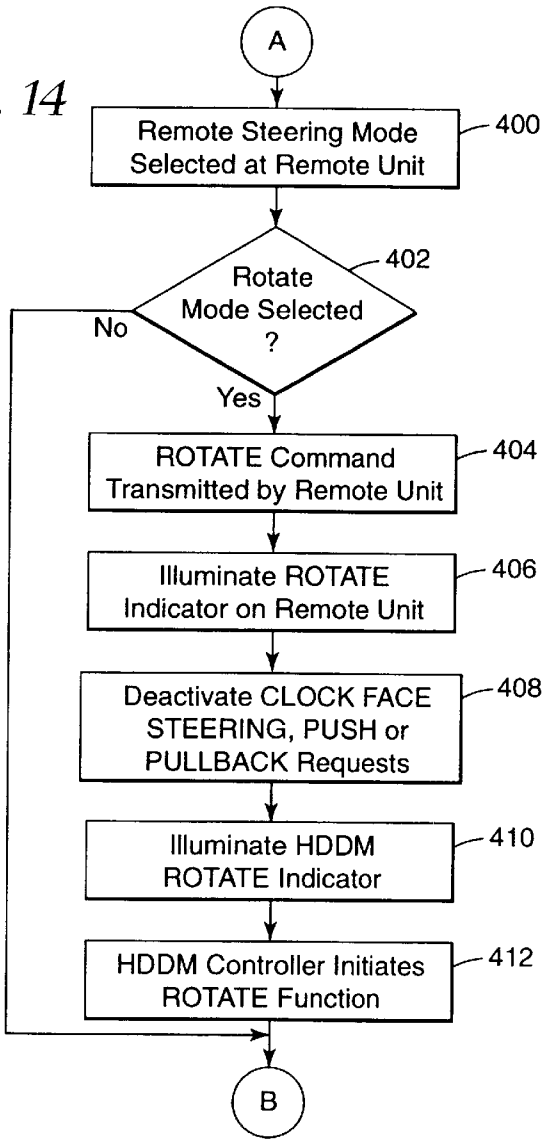
FIG. 14 is a flow diagram that illustrates various steps associated with cooperative operation between a remote unit and an HDD machine controller when operating in a ROTATE mode according to an embodiment of the present invention.
Figure 17:
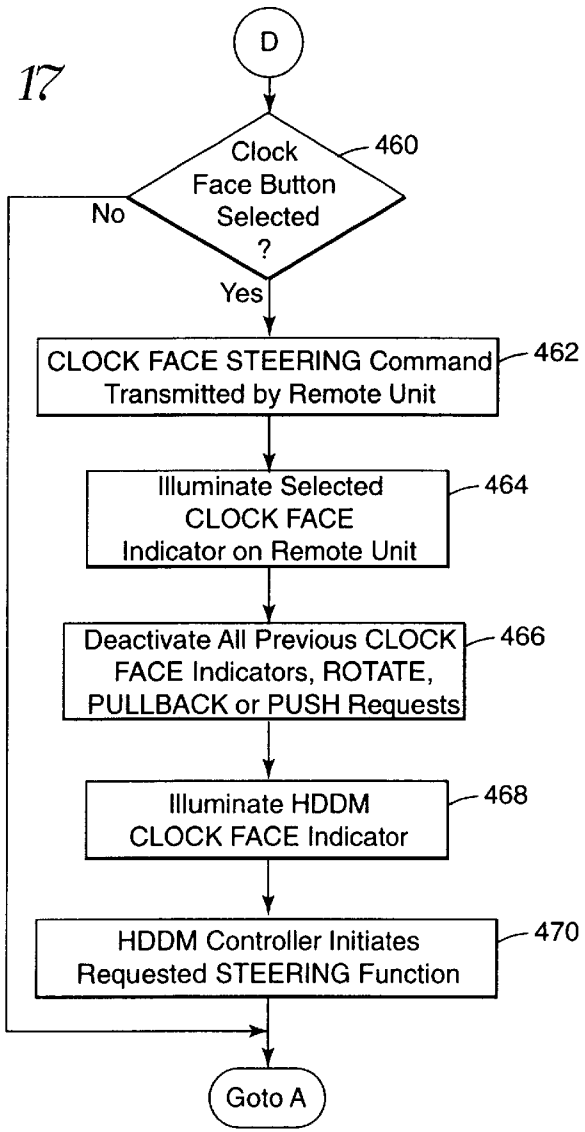
FIG. 17 is a flow diagram that illustrates various steps associated with cooperative operation between a remote unit and an HDD machine controller when implementing remote steering operations according to an embodiment of the present invention.

As is depicted in FIG. 14, if 402 the ROTATE mode is selected by the remote user, a ROTATE command is transmitted 404 by the remote unit. A ROTATE indicator is illuminated 406 on the remote unit, and subsequent CLOCK FACE STEERING, PUSH or PULLBACK requests are deactivated 408 while operating in the ROTATE mode. A ROTATE indicator is also illuminated 410 on the HDD machine.

The HDDM controller initiates 410 the ROTATE function, which may be accomplished through manual intervention or automatically. In one embodiment, as previously discussed, an RS-232 or other suitable communications interface may be provided between the HDDM controller and a display provided on the HDD machine. A ROTATE command received from the remote unit may result in the presentation of the ROTATE request on the display. The HDD machine operator may then manually initiate and control the ROTATE function. Alternatively, the ROTATE command received from the remote unit may be operated upon directly by the HDDM controller to automatically initiate the requested ROTATE function.

Figure 15:
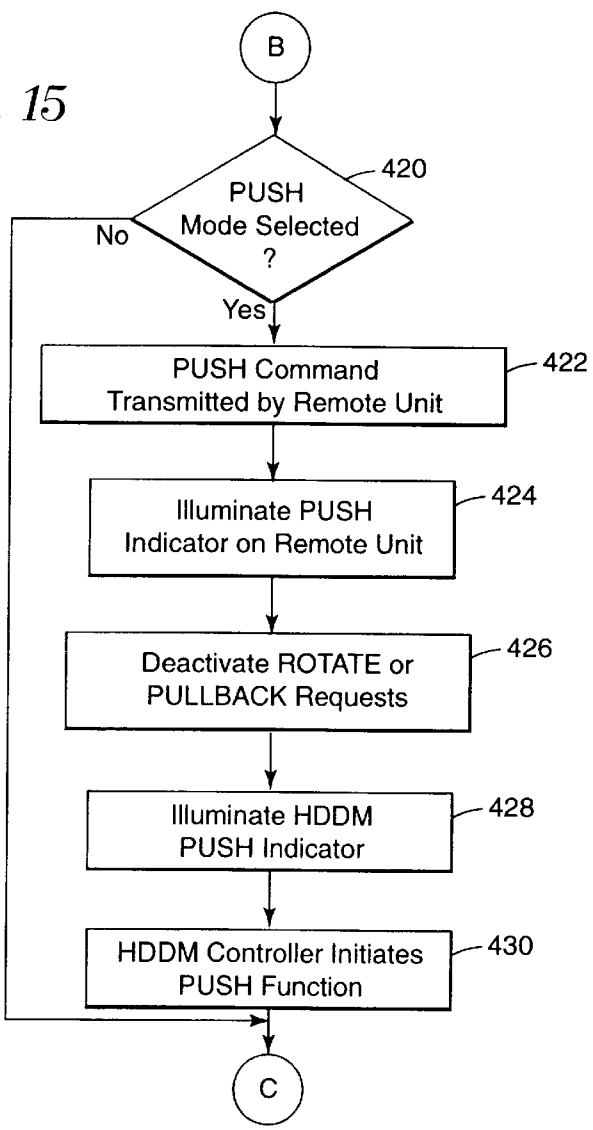
FIG. 15 is a flow diagram that illustrates various steps associated with cooperative operation between a remote unit and an HDD machine controller when operating in a PUSH mode according to an embodiment of the present invention.

In accordance with FIG. 15, if 420 the PUSH mode is selected by the remote user, a PUSH command is transmitted 422 by the remote unit. A PUSH indicator is illuminated 424 on the remote unit, and subsequent ROTATE or PULLBACK requests are deactivated 426 while operating in the PUSH mode. A PUSH indicator is illuminated 428 on the HDD machine.

The HDDM controller initiates 430 the PUSH function, which may be accomplished through manual intervention or automatically. A PUSH command received from the remote unit may result in the presentation of the PUSH request on the display of the HDD machine. The HDD machine operator may then manually initiate and control the PUSH function. Alternatively, the PUSH command received from the remote unit may be operated upon directly by the HDDM controller to automatically initiate the requested PUSH function.

Figure 16:
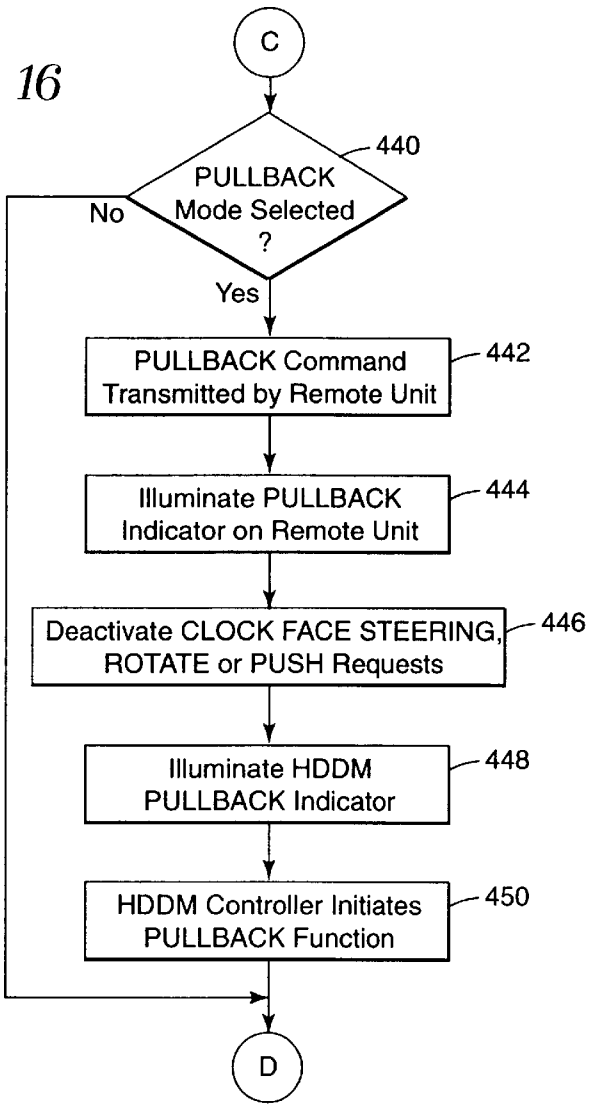
FIG. 16 is a flow diagram that illustrates various steps associated with cooperative operation between a remote unit and an HDD machine controller when operating in a PULL-BACK mode according to an embodiment of the present invention.

If 440 the PULLBACK mode is selected by the remote user, as is depicted in FIG. 16, a PULLBACK command is transmitted 442 by the remote unit. A PULLBACK indicator is illuminated 444 on the remote unit, and subsequent CLOCK FACE STEERING, ROTATE or PUSH requests are deactivated 446 while operating in a PULLBACK mode. A PULLBACK indicator is illuminated 448 on the HDD machine.

The HDDM controller initiates 450 the PULLBACK function, which may be accomplished through manual intervention or automatically. A PULLBACK command received from the remote unit may result in the presentation of the PULLBACK request on the display of the HDD machine. The HDD machine operator may then manually initiate and control the PULLBACK function. Alternatively, the PULLBACK command received from the remote unit may be operated upon directly by the HDDM controller to automatically initiate the requested PULLBACK function.

The remote user may issue clock face-based steering commands using, for example, the steering control 132 depicted in FIG. 4. If 460 the remote user depresses a selected clock face steering button on the remote unit, a CLOCK FACE STEERING command corresponding to the selected clock face "time" is transmitted 462 by the remote unit. The steering button selected by the remote user is illuminated 464 and all previously selected clock face buttons, if applicable, and any subsequent ROTATE, PULLBACK or PUSH requests are deactivated 466 while operating in the clock-based steering mode. A clock face indicator corresponding to that selected by the remote user is illuminated on the HDD machine. The HDD clock face indicator may, for example, constitute a clock face time location highlighted on a clock face graphically presented on the display of the HDD machine.

The HDDM controller initiates 470 the requested STEERING function, which may be accomplished through manual intervention or automatically. A STEERING command received from the remote unit may result in the presentation of the STEERING request on the display of the HDD machine. The HDD machine operator may then manually initiate and control the STEERING function. Alternatively, the STEERING command received from the remote unit may be operated upon directly by the HDDM controller to automatically initiate the requested STEERING function.

In general, a remote unit suitable for use in implementing a LOCK-OUT methodology of the present invention should be capable of transmitting and receiving signals to and from the HDD machine at locations below ground level (e.g., locations not in line-of-sight with the HDD machine). For example, the remote unit should by capable of maintaining communication connectivity with the HDD machine from the bottom of an 8 foot deep pit. Depending on a number of factors, it may be desirable to employ a repeater at ground level proximate the pit to enhance communication between the remote unit and HDD machine for relatively long bore lengths. The transmit range should be on the order of several thousand feet, which may be extended through use of one or more repeaters. As previously discussed, the remote unit should include lost or weak signal detection circuitry with an audible, visual, and/or tactile warning capability.

The remote unit may include circuitry that provides for external radio interference rejection and a capability to change frequencies in accordance with the appropriate waveband for the country or locale of use. Each remote unit preferably has a unique code so that each machine may be controlled by only one remote.

The remote unit is preferably configured for portability and durability, and is preferably wearable and capable of being operated with the use of only one hand. The rechargeable batteries provided in the remote unit are preferably field removable in a manner that does not require the use of tools.

The HDDM controller at the HDD machine may also include circuitry that provides for external radio interference rejection and a capability to change frequencies in accordance with the appropriate waveband for the country or locale of use. The HDDM controller should also include lost or weak signal detection circuitry with an audible, visual, and/or tactile warning capability. The transmit range of the HDD machine transceiver should be on the order of several thousand feet, which may be extended through use of one or more repeaters.

The HDD machine preferably includes an integrated battery charger for charging the batteries of a remote unit and may include a 12/24 Vdc input and self wiping contacts. The battery charger, which is coupled to the HDDM controller, is preferably capable of identifying a remote unit that is not properly programmed to communicate with the transceiver of the particular HDD machine and providing a warning in such a case. The HDDM controller is preferably capable of addressing the HDD machine transceiver with its own unique identification code.

According to one embodiment, the HDD machine includes mode annunciators of varying colors, such as red, yellow, and green indicators, which are easily visible in bright sunlight. A display provided on the HDD machine should similarly be readily visible in bright sunlight.

As previously discussed, a normally closed relay is employed at the HDD machine to activate and de-activate the LOCK-OUT sequence. In one embodiment, a 12 Vdc input signal is generated upon successful completion of the LOCK-OUT sequence. A normally open relay is preferably employed to activate and de-activate the previously described CREEP mode sequence.

A manual reset mechanism is provided at the HDD machine for purposes of resetting the LOCK-OUT state that has been established at the HDD machine resulting from a loss of communication connectivity between the remote unit and the HDD machine. The manual reset procedure requires the HDD machine operator to turn off the HDDM controller and use a reset tool to reset the HDDM controller for continued operation. The HDD machine operator does not have the ability to independently reset a LOCK-OUT condition initiated by the remote user, as was discussed previously.

An RS-232 or other suitable communications interface is preferably provided at the HDD machine to provide for the communication of data to and from a customer provided interface. All LOCK-OUT functions are preferably accessible via the RS-232 port.

It will, of course, be understood that various modifications and additions can be made to the preferred embodiments discussed hereinabove without departing from the scope of the present invention. Accordingly, the scope of the present invention should not be limited by the particular embodiments described above, but should be defined only by the claims set forth below and equivalents thereof.

What is claimed is:

1. A method of remotely altering operation of a horizontal directional drilling machine, the drilling machine comprising a driving apparatus coupled to a drill string and a cutting head or reamer, the method comprising:

transmitting a lockout signal from a location remote from the drilling machine;

receiving the lockout signal at the drilling machine;

preventing movement of the drill string in response to the received lockout signal;

transmitting a verification signal from the drilling machine to the remote location, the verification signal indicative of successful receipt of the lockout signal by the drilling machine and disablement of drill string movement; and detecting a loss of communication connectivity between the drilling machine and the remote location.

2. The method of claim 1, wherein preventing movement of the drill string comprises preventing rotation and displacement of the drill string.

3. The method of claim 1, wherein preventing movement of the drill string comprises clamping the drill string.

4. The method of claim 1, further comprising:

clamping the drill string to prevent drill string movement; and manipulating a drill string rod while clamping the drill string.

5. The method of claim 4, further comprising generating a clamp signal in response to successfully clamping the drill string, wherein the verification signal is transmitted in response to the generated clamp signal.

6. The method of claim 1, wherein the drilling machine further comprises a fluid dispensing unit that supplies fluid, foam, air or a combination thereof into the borehole, the method further comprising disabling supplying of the fluid, foam and/or air into the borehole in response to the received lockout signal.

7. The method of claim 1, further comprising communicating to an operator at the remote location one or more of a visual, audible, and/or tactile indication in response to receiving the verification signal at the remote location.

8. The method of claim 1, further comprising communicating to an operator at the remote location one or more of a visual, audible, and/or tactile warning indication in response to not receiving the verification signal at the remote location after expiration of a predetermined time period following transmission of the lockout signal.

9. The method of claim 1, further comprising communicating to a user at the remote location one or more of a visual, audible and/or tactile indication of the loss of communication connectivity between the drilling machine and the remote location.

10. The method of claim 1, further comprising communicating to a user at the remote location one or more of a visual, audible and/or tactile warning indication in response to a change of state at the drilling machine that affects movement of the drill string and/or a supply of the fluid, foam and/or air into the borehole.

11. The method of claim 1, further comprising communicating to an operator of the drilling machine one or both of a visual and/or audible indication of receipt of the lockout signal transmitted from the remote location.

12. The method of claim 1, further comprising:

transmitting an operating mode signal from the remote location;

receiving the operating mode signal at the drilling machine; and altering operation of the drilling machine in response to the operating mode signal.

13. The method of claim 12, wherein:

the operating mode signal comprises a CREEP mode signal; and altering drilling machine operation comprises reducing drill string displacement from a nominal level to a pre-established level in response to the CREEP mode signal.

14. The method of claim 12, wherein:

the operating mode signal comprises one of a PUSH, PULLBACK or ROTATE mode signal; and altering drilling machine operation comprises altering forward drill string displacement in response to the PUSH mode signal, altering reverse drill string displacement in response to the PULLBACK mode signal or altering drill string rotation in response to the ROTATE mode signal.

15. The method of claim 12, wherein:

the operating mode signal comprises a STEERING mode signal; and altering drilling machine operation comprises imparting a heading change at the cutting head in response to the STEERING mode signal.

16. The method of claim 12, wherein altering drilling machine operation is effected automatically or in response to user control inputs.

17. A system for remotely altering operation of a horizontal directional drilling machine, the drilling machine comprising a driving apparatus coupled to a drill string and a cutting head or reamer, the system comprising:

a remote unit comprising a transceiver;

a user interface provided on the remote unit, the user interface comprising a lockout switch, a status indicator, and a mode indicator, the remote unit transmitting via the transceiver a lockout signal in response to user actuation of the lockout switch; and a controller provided at the drilling machine communicatively coupled to the driving apparatus, the controller preventing movement of the drill string in response to the received lockout signal and transmitting a verification signal to the remote unit, the mode indicator of the remote unit, in response to the received verification signal, communicating to the user one or more of a visual, tactile and/or audible indication of successful receipt of the lockout signal by the drilling machine and disablement of drill string movement, and the status indicator indicating a loss of communication connectivity between the remote unit and the drilling machine.

18. The system of claim 17, wherein the driving apparatus comprises a rotation pump/motor and a displacement pump/motor each coupled to the drill string, the controller preventing movement of the drill string by disabling the rotation pump/motor and the displacement pump/motor.

19. The system of claim 17, further comprising:

a clamp mechanism mounted to the drilling machine which selectively engages and disengages the drill string to respectively prevent and permit movement of the drill string; and a drill rod manipulation device, wherein the controller actuates the clamp mechanism to prevent movement of the drill string and contemporaneously enables the drill rod manipulation device to manipulate a drill rod relative to the clamped drill string.

20. The system of claim 19, further comprising a clamp sensor, the clamp sensor generating a clamp signal in response to the clamp mechanism successfully engaging the drill string so as to prevent drill string movement, wherein the controller transmits the verification signal in response to receiving the clamp signal generated by the clamp sensor.

21. The system of claim 17, wherein the drilling machine further comprises a fluid dispensing unit that supplies fluid, foam and/or air through the drill string, the controller disabling dispensing of the fluid, foam, and/or air in response to the received lockout signal.

22. The system of claim 17, wherein the remote unit comprises one or more of a visual, audible, and/or tactile indicator, the indicator providing an indication of receipt of the verification signal.

23. The system of claim 17, wherein the remote unit comprises a timer and one or more of a visual, audible, and/or tactile warning indicator, the warning indicator providing an indication of non-receipt of the verification signal after elapsing of the timer following transmission of the lockout signal.

24. The system of claim 17, wherein the remote unit comprises one or more of a visual, audible and/or tactile warning indicator, the indicator providing an indication of a change of state at the drilling machine that affects movement of the drill string.

25. The system of claim 17, wherein the user interface comprises an indicator that indicates relative strength of a signal communicated between the remote unit and the drilling machine.

26. The system of claim 17, further comprising one or more repeaters for enhancing communication of signals between the remote unit and the drilling machine.

27. The system of claim 17, wherein the controller is coupled to one or both of a visual and/or audible indicator, the controller activating the indicator in response to the lockout signal.

28. The system of claim 17, wherein the remote unit further comprises a user actuatable operating mode control, the operating mode control, when actuated by the user, producing an operating mode signal and the controller altering operation of the drilling machine in response to the operating mode signal.

29. The system of claim 17, wherein the operating mode signal comprises a CREEP mode signal, and the controller reduces drill string displacement from a nominal level to a pre-established level in response to the CREEP mode signal.

30. The system of claim 17, wherein the operating mode signal comprises one of a PUSH, PULLBACK or ROTATE mode signal, and the controller alters forward drill string displacement in response to the PUSH mode signal, alters reverse drill string displacement in response to the PULLBACK mode signal or alters drill string rotation in response to the ROTATE mode signal.

31. The system of claim 30, wherein the controller alters drilling machine operation automatically or in response to user control inputs.

32. The system of claim 17, wherein the remote unit comprises a user actuatable steering control, the steering control, in response to user actuation, producing a STEERING mode signal, and the controller effecting cutting head steering changes in response to the STEERING mode signal.

33. The system of claim 32, wherein the steering control comprises a plurality of switches each representative of a position on clock face, the STEERING mode signal indicative of a desired cutting head steering direction corresponding to the position of an actuated switch on the clock face.

* * * * *